US007013614B2

(12) United States Patent
Tange et al.

(10) Patent No.: US 7,013,614 B2
(45) Date of Patent: Mar. 21, 2006

(54) BINDING MACHINES

(75) Inventors: Shino Tange, 172 Yakushiyama, Narumi-cho, Midori-ku, Aichi-ken (JP) 458-0846; Soichi Tange, Aichi-ken (JP); Yayoi Tange, 172 Yakushiyama, Narumi-cho, Midori-ku, Aichi-ken (JP) 458-0846

(73) Assignees: Kyowa Limited, Osaka (JP); Shino Tange, Aichi (JP); Souichi Tange, Aichi (JP); Yayoi Tange, Achi (JP)

( * ) Notice: Subject to any disclaimer, the term of this patent is extended or adjusted under 35 U.S.C. 154(b) by 0 days.

(21) Appl. No.: 10/472,348

(22) PCT Filed: Mar. 4, 2002

(86) PCT No.: PCT/JP02/01990

§ 371 (c)(1),
(2), (4) Date: Feb. 23, 2004

(87) PCT Pub. No.: WO02/076831

PCT Pub. Date: Oct. 2, 2003

(65) Prior Publication Data

US 2004/0144068 A1 Jul. 29, 2004

(30) Foreign Application Priority Data

Mar. 22, 2001 (JP) ..... 2001-082291

(51) Int. Cl.
*B65B 13/28* (2006.01)
*B65B 51/08* (2006.01)

(52) U.S. Cl. ..... 53/138.6; 53/138.8; 53/586; 53/370; 100/100; 100/31; 140/93.6; 140/93 A

(58) Field of Classification Search .... 53/138.6–138.8, 53/139.4, 583, 586, 370; 100/10, 16, 25, 100/31, 33 R; 140/93 A, 93.6; B65B 51/08
See application file for complete search history.

(56) References Cited

U.S. PATENT DOCUMENTS 1,400,327 A * 12/1921 Sparks ..... 53/138.7

(Continued)

FOREIGN PATENT DOCUMENTS

CH 49675 9/1970

(Continued)

OTHER PUBLICATIONS

Supplementary European Search Report (Date of Completion of the Search Jun. 18, 2004, Communication dated Jul. 12, 2004).
European Search Report for EP0087310 (date of completion of the search May 25, 1983).

*Primary Examiner*—Stephen F. Gerrity
(74) *Attorney, Agent, or Firm*—Hisako Muramatsu, Esq.

(57) ABSTRACT

A binding machine is provided having a base member with a bifurcated shape in the front side thereof, into which an item can be inserted; a tie feed mechanism that feeds out a tie-like member of a predetermined length in the width direction of the base member so as to transverse an opening formed between the bifurcations of the base member; a tie guide mechanism having a pair of tie guide members capable of moving respectively in the substantially front/rear direction of the base member at the side areas of the opening thereby to press the front end side and the fed-out end side of the tie-like member toward the rear side by the respective front end portions, and a guide mechanism that guides each tie guide member toward the rear side substantially parallel to the opening, and turns the respective front end portions around toward the rear side of the opening thereby to make the respective front end portions closer to each other at the rear side of the opening; and a tying mechanism, provided at the rear side of the opening for tying.

3 Claims, 25 Drawing Sheets

U.S. PATENT DOCUMENTS

| | | | | | |
|---|---|---|---|---|---|
| 2,478,435 | A | | 8/1949 | Swenson et al. | |
| 3,369,573 | A | | 2/1968 | Baker et al. | |
| 3,717,972 | A | * | 2/1973 | Niedecker | 53/138.4 |
| 4,043,363 | A | * | 8/1977 | Tange | 140/93 A |
| 4,054,160 | A | * | 10/1977 | Knudsen | 140/93 A |
| 4,087,951 | A | * | 5/1978 | Tsuda et al. | 53/583 |
| 4,101,366 | A | | 7/1978 | Teraoka et al. | |
| 4,169,346 | A | * | 10/1979 | Tange | 53/583 |
| 4,393,641 | A | * | 7/1983 | Niedecker | 53/583 |
| 4,865,087 | A | | 9/1989 | Geiger | |
| 5,088,394 | A | | 2/1992 | Bertrand et al. | |

FOREIGN PATENT DOCUMENTS

| | | | | |
|---|---|---|---|---|
| DE | 1461945 | A | | 1/1965 |
| DE | 1786506 | | | 5/1972 |
| DE | 2356053 | | | 5/1975 |
| EP | 0 087 310 | A | | 8/1983 |
| EP | 0 661 210 | A1 | | 7/1995 |
| FR | 1215076 | | | 4/1960 |
| GB | 2076549 | A | | 12/1981 |
| JP | 52 112496 | A | | 9/1977 |
| JP | 07010120 | A | * | 1/1995 |
| JP | 2001018918 | A | * | 1/2001 |

* cited by examiner

BINDING MACHINES

TECHNICAL FIELD

The present invention relates to a binding machine, and in particular, to a binding machine that ties an item to be tied (referred to as item, hereinafter) such as rod-like item using a tie-like member capable of tying by being twisted.

BACKGROUND ART

There is known, as a conventional binding machine, the binding machine disclosed in U.S. Pat. No. 4,169,346.

The binding machine is provided with an opening available for inserting an item therein. A bifurcated arm is moved toward the recess of the opening so as to traverse the opening. Both ends of a tie-like member are guided toward the lower portion of the item by the front-end portions of the bifurcated arm; thereby the tie-like member is turned around the item. Thus, the both ends of the tie-like member are tied by being twisted.

DISCLOSURE OF THE INVENTION

The conventional binding machine suffers from the problem in which when an operator carries out tying operation by inserting an item into the opening, since the bifurcated arm moves traversing the opening, the operator is given with sensation of fear.

In view of the problem, an object of the present invention is to provide a binding machine with which an operator can carries out the tying operation with security.

To attain the object, an embodiment of the present invention comprises: a base member having a bifurcated shape in the front side thereof, into which an item can be inserted; a tie feed mechanism that feeds out a tie-like member of a predetermined length in the width direction of the base member so as to transverse an opening formed between the bifurcations of the base member; a tie guide mechanism having a pair of tie guide members capable of moving respectively in he substantially front/rear direction of the base member at the side areas of the opening thereby to press the front end side and the fed-out end side of the tie-like member toward the rear side by the respective front end portions, and a guide mechanism that guides each tie guide member toward the rear side substantially parallel to the opening, and turns the respective front end portions around toward the rear side of the opening thereby to make the respective front end portions closer to each other at the rear side of the opening; and a tying mechanism, provided at the rear side of the opening, for tying by twisting both end sides of the tie-like member.

According to the embodiment of the present invention as described above, when the tie feed mechanism feeds out a tie-like member of a predetermined length in the width direction of the base member so as to traverse the opening available for inserting an item therein, which opening is formed in the front side of the base member; the tie guide mechanism allows the guide mechanism, in the side areas of the opening, to guide a pair of tie guide members roughly parallel to the opening toward the rear side, and to turn the respective front end portions toward the rear side of the opening, and thereby making the respective front end portions closer to each other at the rear side of the opening.

At this time, since the respective tie guide member presses the front end side and the fed-out end side respectively of the tie-like member by the respective front end portions thereof toward the rear side, and makes the tie-like member turn around the periphery of the item, the tying mechanism, provided in the rear side of the opening, twists to tie both end sides of the tie-like member.

The above-described construction, in carrying out the tying operation of the item, allows the tie-like member to traverse the opening and does not allow the tie guide member to traverse the opening, thus freeing an operator who inserts the item into the opening from sensation of fear caused by the movement of the tie guide member.

Here, the wording of "front side" means a relative position only when the base member is viewed as a whole. Accordingly, the orientation of the opening may be appropriately changed depending on the positioning of the base member.

The tie feed mechanism, so long as it can feed a tie-like member of a predetermined length in the width direction so as to traverse the opening between the bifurcations of the base member, may be modified as: one mechanism where a continuously formed tie-like member may be cut and fed; and the other mechanism where a tie-like member, which has been previously cut, may be fed out. In the former case, in order to adjust the length of the tie-like member to be fed out, an adjusting mechanism may be provided depending on the necessity.

As for the tie guide member, any guide member that is capable of moving in the roughly front/rear direction in the side areas of the opening, and pushing the front end side and the fed-out side end of the tie-like member with the respective front end parts thereof toward the rear side may be adopted. According to an embodiment of the present invention each of the tie guide members is supported by a movable member which is driven together in the front/rear direction.

When the movable members are driven in the front/rear direction, each of the tie guide members supported by the movable members moves together forward/backward. In this embodiment, the construction is simplified by arranging so as to support each of the tie guide members with the same member to move them forward/backward. However, the construction is just an example. Each of the tie guide members may be moved forward/backward separately.

As for the guide mechanism, any guide mechanism may be adopted so long as it guides each of the tie guide members roughly parallel to the opening toward the rear side, turns the respective front ends toward the rear side of the opening thereby to make the respective front ends closer to each other at the rear side of the opening.

In yet another embodiment of the present invention, the guide mechanism is provided with a concavo-convex structure. The concavo-convex structure, formed between the base member and the respective tie guide members, is constructed such that: in the front side of the base member, moves the tie guide members toward the rear side roughly parallel to the opening portion; and in the rear side of the base member, turns the respective front end portions of the tie guide member around toward the rear side of the opening thereby to make each front ends closer to each other at the rear side of the opening.

According to this embodiment of the present invention as described above, the concavo-convex guide structure, formed between the base member and the respective tie guide members, guides in the front side of the base member, the tie guide member toward the rear side roughly parallel to the opening portion; and in the rear side, turns the respective front-end portions of the tie guide member toward the rear side of the opening thereby to make the respective front end portions closer to each other at the rear side of the opening.

BEST MODE FOR CARRYING OUT THE INVENTION

Herein, an embodiment of the present invention will be described in the following order.

(1) outline of binding machine main body:
(2) tie feed mechanism:
(3) cutter mechanism:
(4) tie holding mechanism:
(5) tie guide mechanism:
(6) tying mechanism:
(7) switch mechanism:
(8) chattering preventive structure:
(9) outline of entire binding machine:

(1) Outline of Binding Machine Main Body

Figure 1:
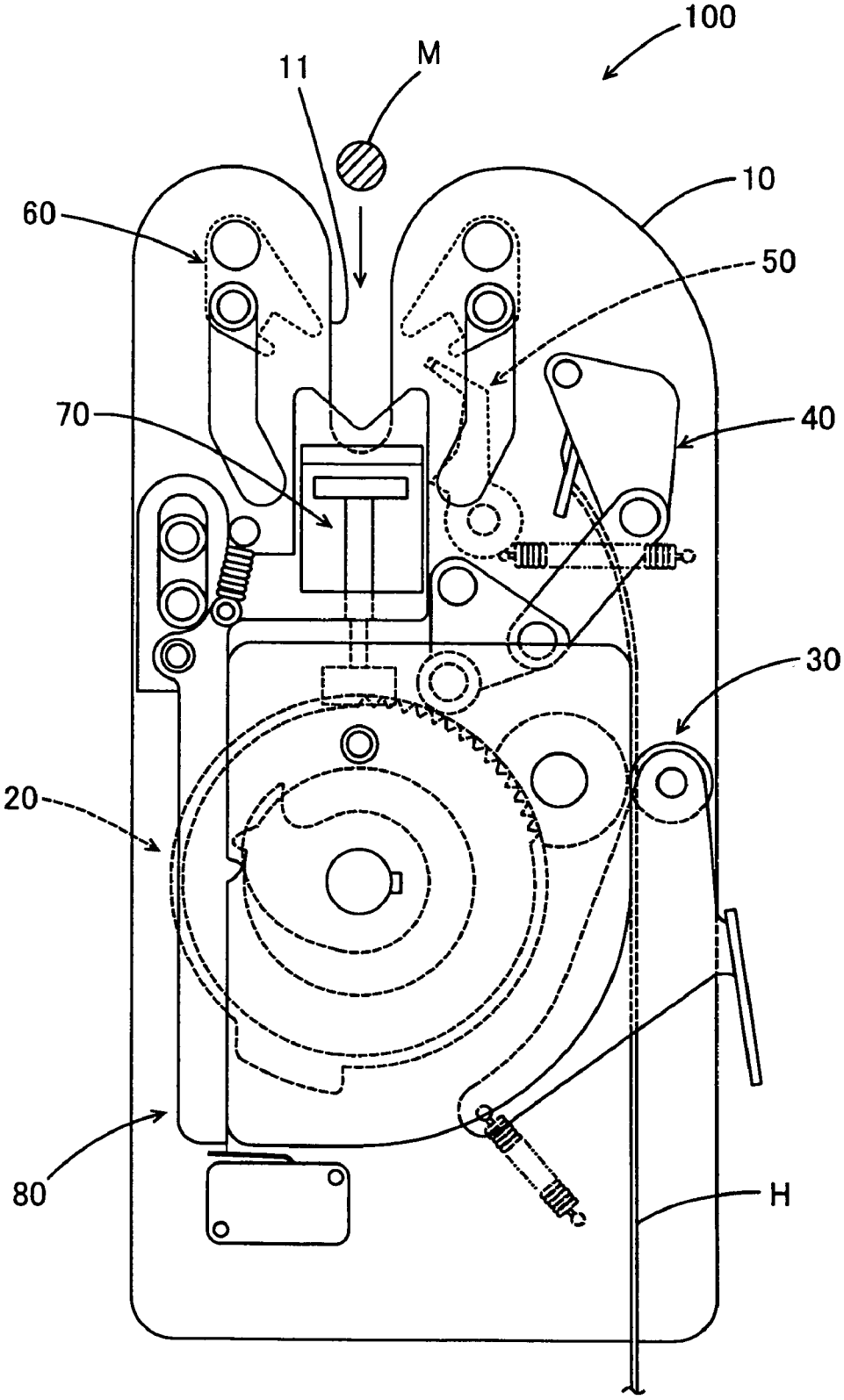
FIG. 1 is a plan view showing a primary construction of a binding machine main body according to an embodiment of the present invention.

FIG. 1 is a plan view showing a primary construction of a binding machine main body 100 according to an embodiment of the present invention. Hereafter, the upper part of the drawings will be referred to as front part; the part toward you in the drawings will be referred to as upper part. However, the direction may be appropriately changed depending on the operation location.

In the front part of a base member 10, an opening 11, into which an item M to be tied (referred to as item M, hereinafter) can be inserted, is formed, and disposed in the rear part thereof is a rotating member 20. Also, provided to the base member 10 are a tie feed mechanism 30, a cutter mechanism 40, a tie holding mechanism 50, a tie guide mechanism 60, a tying mechanism 70 and a switch mechanism 80, which are driven according to the rotation of the rotating member 20.

Owing to the construction, when an item M is inserted into the opening 11, the power supply is turned on by the switch mechanism 80, the tie feed mechanism 30 feeds a tie-like member H toward the opening 11 and the tie holding mechanism 50 presses the tie-like member H from the front side against the item M.

Then, the cutter mechanism 40 cuts off the tie-like member H at a predetermined length, and the tie guide mechanism 60 turns the cut tie-like member H around the item M. Owing to this, the tying mechanism 70 ties the tie-like member H by twisting the both ends thereof.

Figure 2:
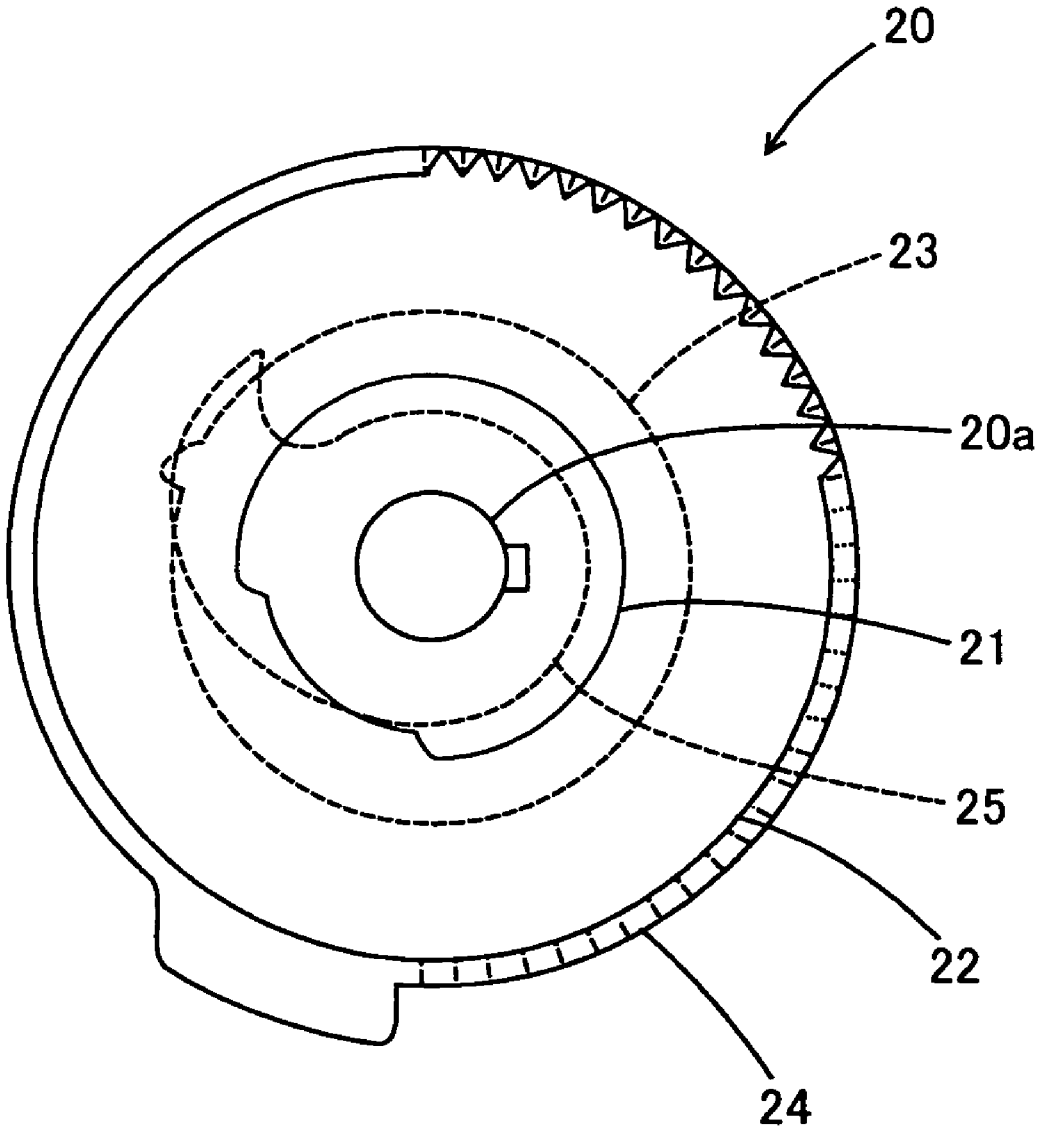
FIG. 2 is a plan view showing a construction of a rotating member.

The rotating member 20 is, as shown in FIG. 2, supported by a shaft 20*a* protruding upward from the base member 10, and the shaft 20*a* is driven to rotate clockwise by a motor (not shown) disposed below the base member 10.

The rotating member 20, in which a drive cam 21 for the switch mechanism, a drive gear 22 for the tie feed mechanism, a drive cam 23 for the switch mechanism, a drive gear 24 for the cutter mechanism and the tying mechanism, and a drive cam 25 for the tie holding mechanism and the tie guide mechanism are piled up in order from the top in a coaxial state, carries out a sequential tying operation while performing a rotation.

Figure 3:
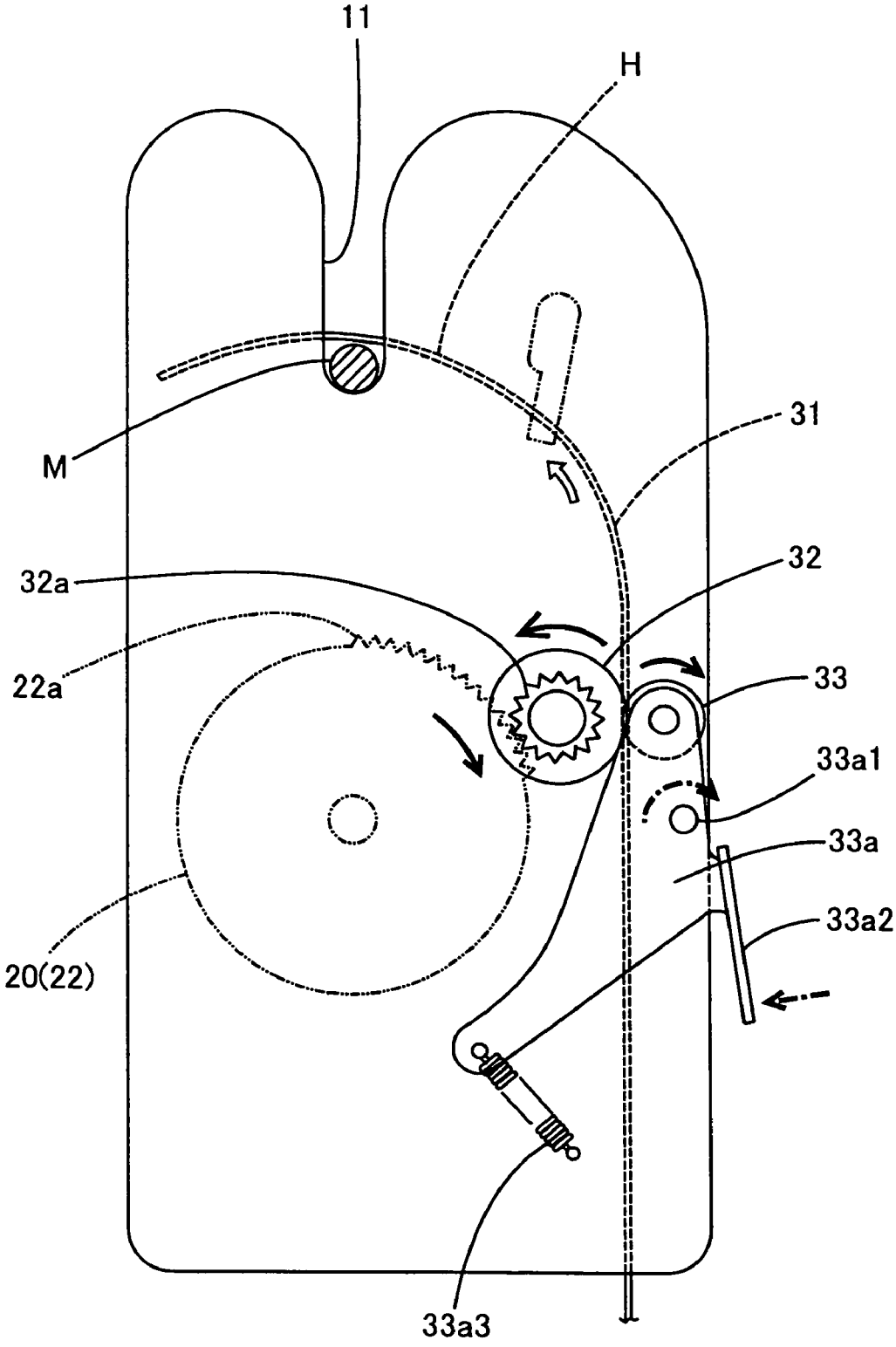
FIG. 3 is a plan view showing a primary construction of a tie feed mechanism.

(2) Tie Feed Mechanism:

FIG. 3 is a plan view showing a primary construction of the tie feed mechanism 30.

Formed on the base member 10 from a right-rear portion thereof toward the opening 11 is a guide path 31 capable of guiding the tie-like member H, disposed between the guide path 31 and the rotating member 20 (drive gear 22) is a first tie feed roller 32, and disposed at the right side of the guide path 31 is a second tie feed roller 33.

The first and second tie feed rollers 32 and 33 are respectively supported rotatably by a shaft vertically provided upward, and a rotation gear 32*a* integrally formed coaxially with the first tie feed roller 32 is meshed with a geared portion 22*a* of the drive gear 22 only in a specific period of time.

Owing to the construction, when the drive gear 22 rotates clockwise, the rotation gear 32*a*, meshed with the geared portion 22*a*, rotates counterclockwise, and the first tie feed roller 32 rotates counterclockwise. Accordingly, the tie-like member H sandwiched between the first tie feed roller 32 and the second tie feed roller 33 is fed toward the front side of the base member 10 at a predetermined length by the turning forth of the first tie feed roller 32. Here, the wording "predetermined length" means a length that, when the tie-like member H has traversed the opening 11, the length from the front end thereof to a point where the tie like member H faces the item M is almost the same as the length from the point where the tie like member H faces the item M to a blade receiving member 41 (later described in a section of the cutter mechanism 40).

The second tie feed roller 33 is supported by an operation lever 33*a*, which is disposed so as to be rotatable around a fixing pin 33*a*1 as the fulcrum thereof in FIG. 3; and the operation lever 33*a* is provided with a press operation piece 33*a*2 at a point right rear of the fixing pin 33*a*1, the rear end thereof is biased toward the right-rear by the pull spring 33*a*3.

Accordingly, when the press operation piece 33*a*2 is pressed leftward against the biasing force of the pull spring 33*a*3, the operation lever 33*a* rotates clockwise and the second tie feed roller 33 is separated from the first tie feed roller 32. This permits to sandwich the tie-like member H between the first tie feed roller 32 and the second tie feed roller 33 so as to be ready to feed out the tie-like member H.

Figure 4:
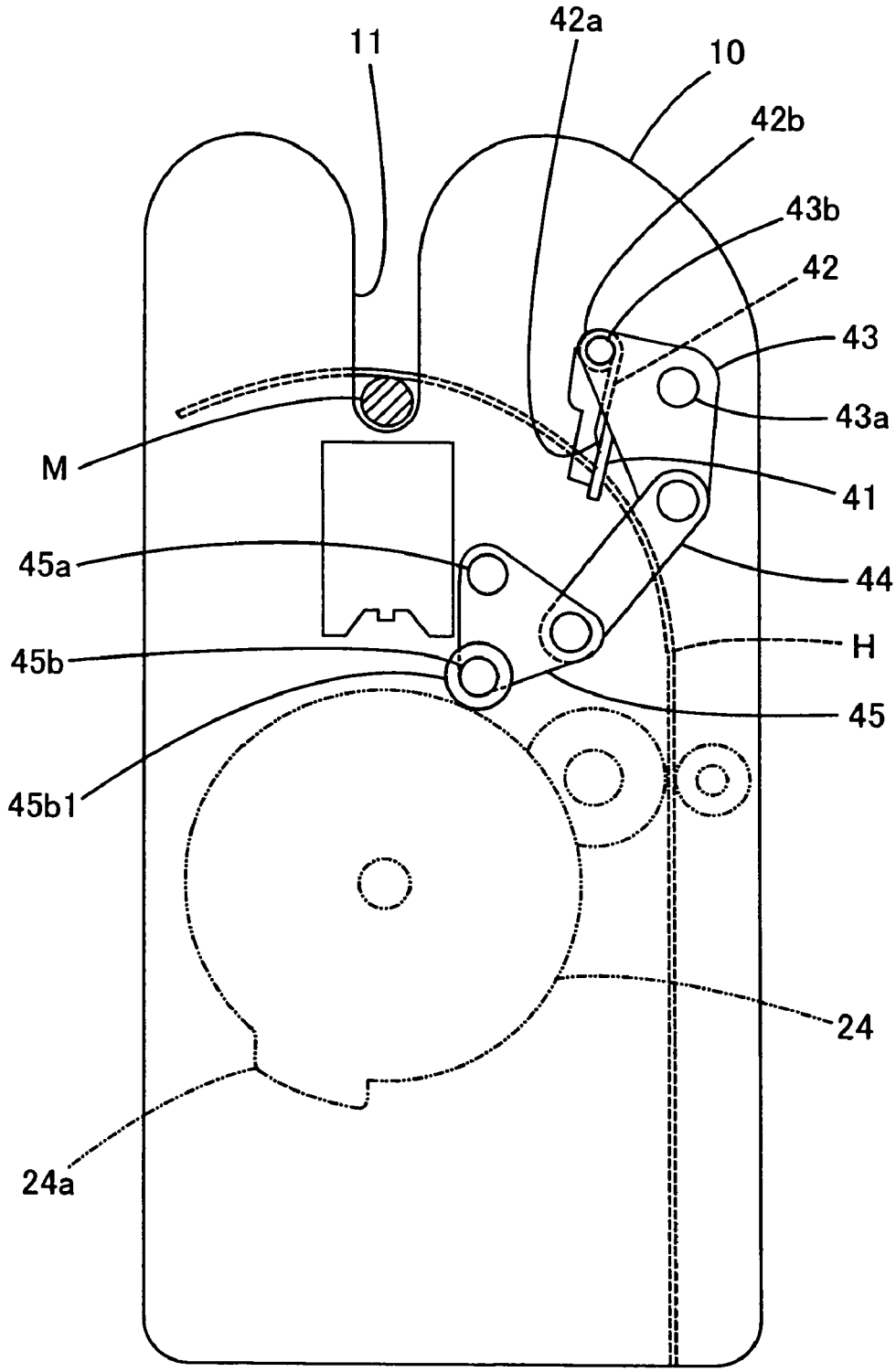
FIG. 4 is a plan view showing a primary construction of a cutter mechanism.

(3) Cutter Mechanism:

FIG. 4 is a plan view showing a primary construction of the cutter mechanism 40.

Figure 5:
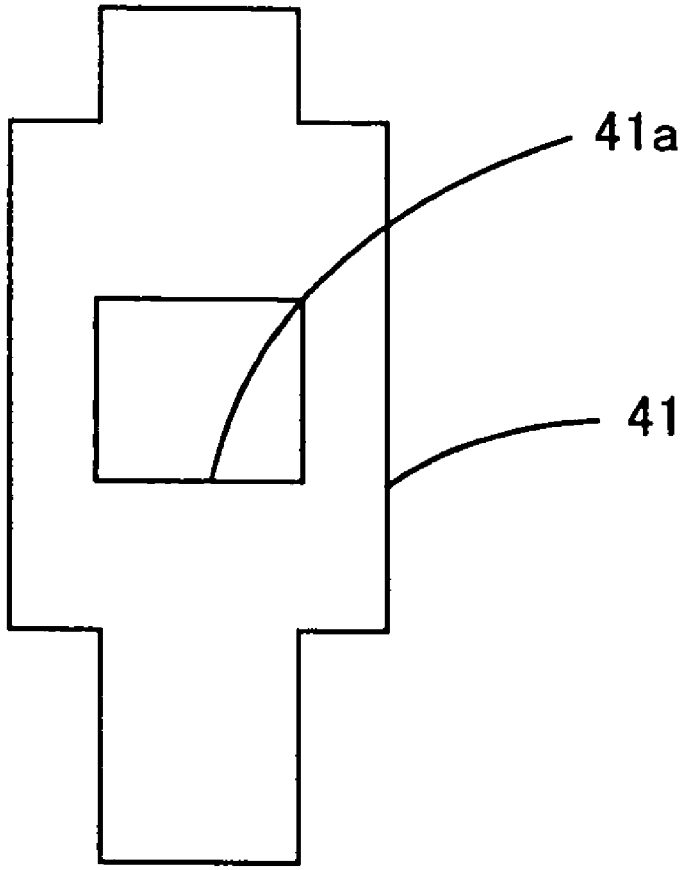
FIG. 5 is a plan view showing a construction of a blade-receiving member.

Disposed at the right side of the opening 11 is a blade receiving member 41 shown in FIG. 5, and an aperture 41*a* of the blade-receiving member 41 is positioned to interpose in the way of the guide path 31. Accordingly, the tie-like member H fed out from the tie feed mechanism 30 is supplied to the opening 11 through the aperture 41*a* of the blade-receiving member 41.

Disposed movably forward/backward on the left surface of the blade receiving member 41 is a cutter member 42; the cutter member 42 waits at the front side of the aperture 41*a* while the tie-like member H is fed out from the tie feed mechanism 30, and when the feed out operation of the tie-like member H has completed, the cutter member 42 slides toward the rear side along the left surface of the blade receiving member 41 and closes the aperture 41*a*, thereby the tie-like member H is cut off.

As described above, in order to move the cutter member 42 forward/backward at a predetermined timing, the cutter mechanism 40 has movable members 43–45, which are connected to each other, disposed therein. The movable member 43 has a roughly triangle-like shape and is supported rotatably by a pivot pin 43*a* in the apex at the front-right thereof. Also, in the apex at the front-left of the movable member 43, a vertically oriented support pin 43*b* is supported; and the cutter member 42 is supported by the support pin 43*b*.

The cutter member 42 is provided with a cutter blade 42*a* at the rear edge of a plate member having a roughly rectangular shape, and front end thereof is curled into a ring-like shape to form a support portion 42*b*. By inserting the support pin 43*b* into the support portion 42*b*, the cutter member 42 is supported rotatably by the movable member 43.

Figure 6:
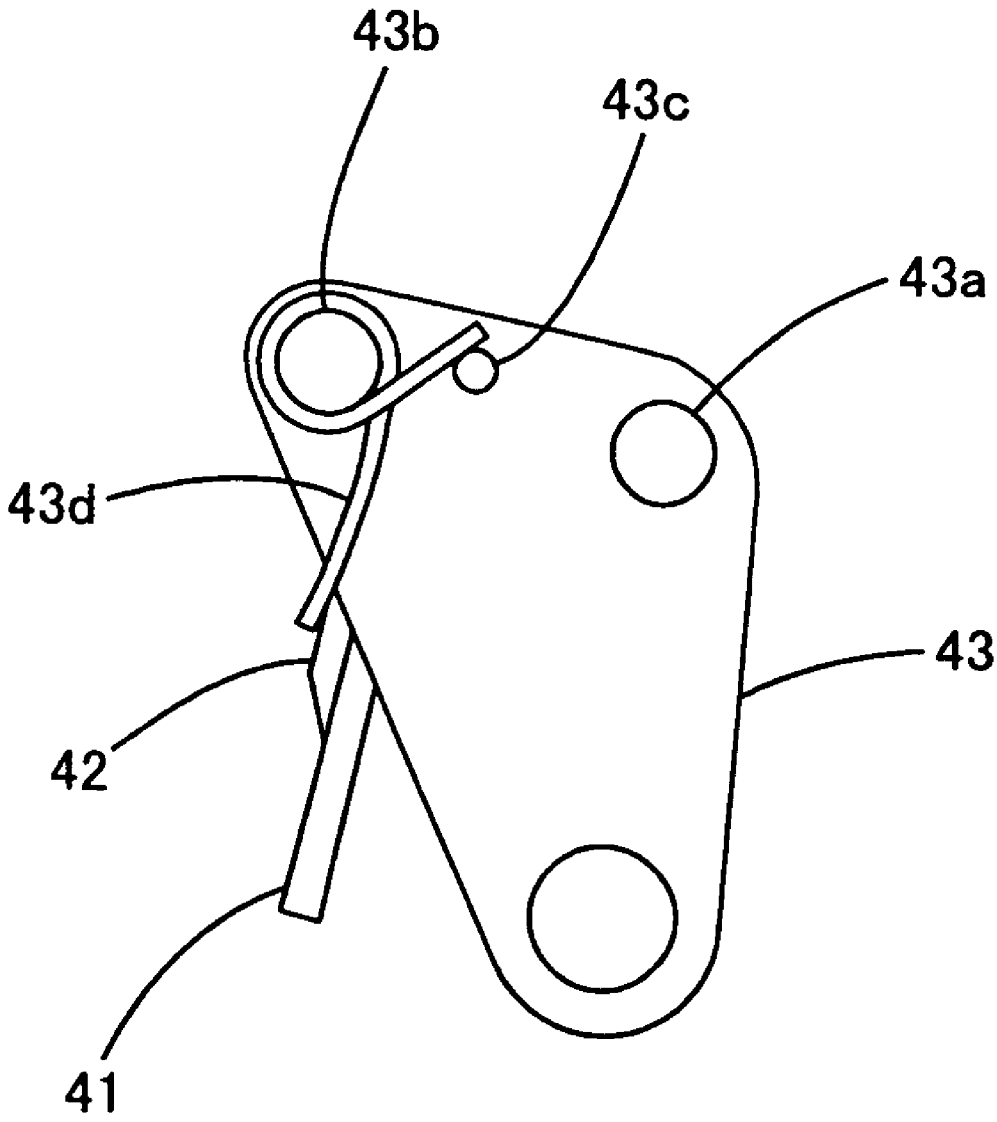
FIG. 6 is a plan view showing a primary construction in a cutter member holding portion.

Further, to the movable member 43, as shown in FIG. 6, a holder pin 43*c* is provided vertically upward at the front-right of the support pin 43*b*, and the front end of a spring member 43*d*, which is formed by coiling a wire once, is brought into contact with the left side of the holder pin 43*c*. The rear end of the spring member 43*d* is bent downward so that the front end is brought into contact with the left side face of the cutter member 42.

Owing to the construction, the spring member 43*d* tends to make the front end and the rear end thereof displace rightward and leftward respectively. However, the front end is pressed from the right by the holder pin 43*c*; and the rear end is pressed from the right by the cutter member 42. At this time, since the position of the blade receiving member 41 is fixed by a side wall of a concave portion formed in the base member 10; and since the cutter member 42 is positioned in the right/left direction by the blade receiving member 41, the rear end of the spring member 43*d* is prevented from being displaced in the right/left direction by the cutter member 42.

Accordingly, when the movable member 43 turns counterclockwise around the pivot pin 43*a* as the fulcrum, since the front end of the spring member 43*d* displaces leftward, the spring member 43*d* deforms so that both of the front and rear ends are separated from each other. Then, on the spring member 43*d*, such biasing force that presses back the both front and rear ends in the direction to be closer to each other to return to the initial configuration thereof is generated. In the apex at the rear-right of the movable member 43, the front end of the movable member 44 is connected movably.

On the other hand, likewise the movable member 45 has a roughly triangle-like shape, being supported rotatably by a pivot pin 45*a* in the apex at the front-left, and a pusher pin 45*b* protruding upward is provided in the apex of the rear part. Attached to the pusher pin 45*b* is a ring-like member 45*b*1, which is rotatable freely, and the ring-like member 45*b*1 always comes into contact with the periphery edge of the drive gear 24. Also, rotatably connected to the apex at the front-right of the movable member 45 is the rear end of the movable member 44.

Figure 7:
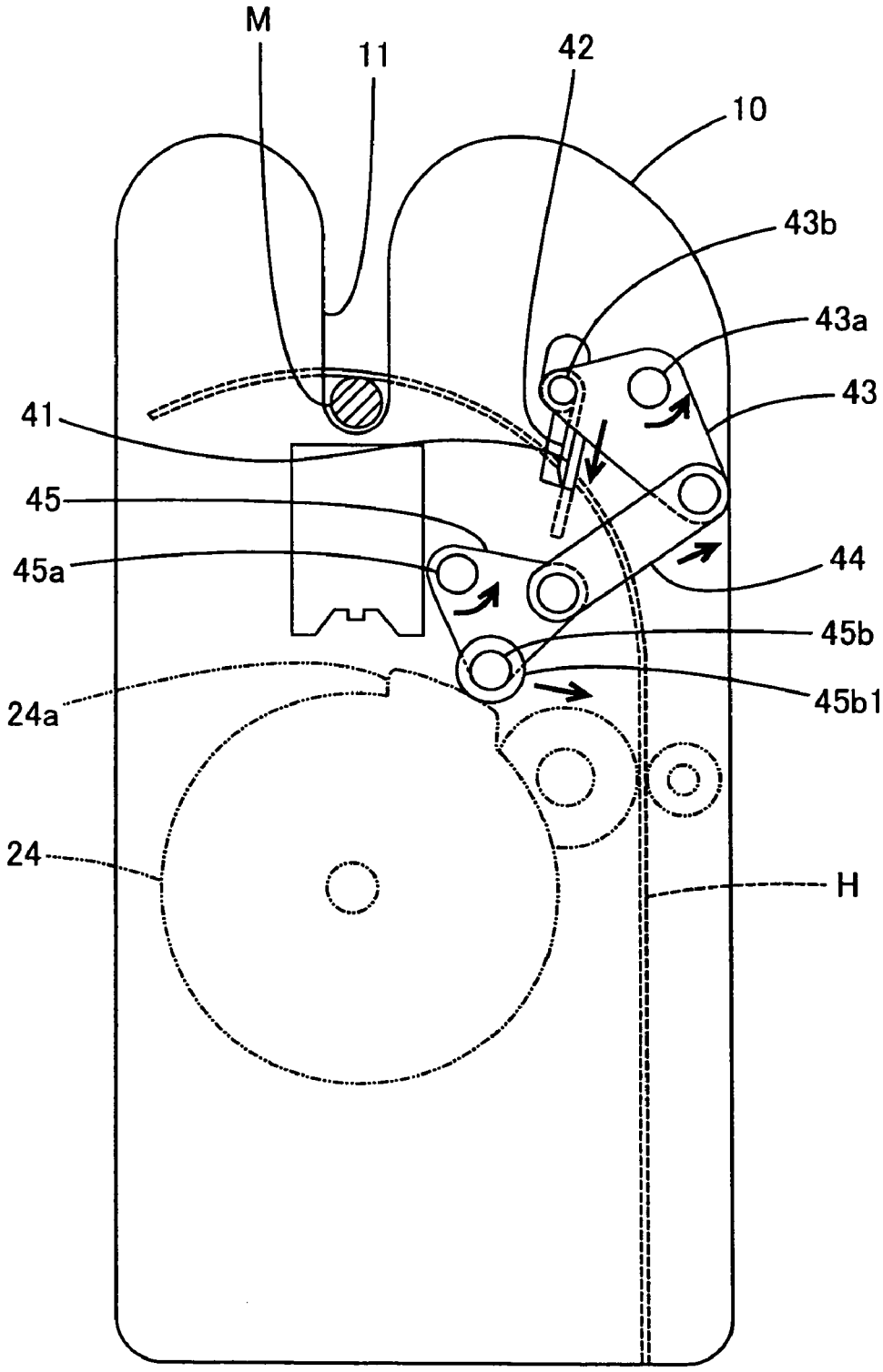
FIG. 7 is a plan view showing a cutter mechanism when a tie-like member is cut off.

The cutter mechanism 40, which has the construction, operates as shown in FIG. 7 to cut off the tie-like member H.

That is, when the rotating member 20 rotates clockwise, a convex portion 24*a* formed on the drive gear 24 faces the ring-like member 45*b*1, and when the pusher pin 45*b* is pushed rightward accompanying the rotation of the drive gear 24, the movable member 45 rotates counterclockwise around the pivot pin 45*a* as the fulcrum. Then, since the movable member 44 is pushed up toward the front-right, the movable member 43 also rotates counterclockwise around the pivot pin 43*a* as the fulcrum against the biasing force of the spring member 43*d*. Accordingly, accompanying the displacement of the support pin 43*b* toward the rear side, the cutter member 42 moves to the rear side along the left surface of the blade receiving member 41 and cuts off the tie-like member H while traversing the aperture 41*a*.

The rotating member 20 further rotates, and when the convex portion 24*a* of the drive gear 24 retracts from the position where the convex portion 24*a* faces ring-like member 45*b*1, owing to the restoring force of the spring member 43*d*, the movable member 43 is forced to return clockwise. Accordingly, accompanying the return of the movable member 44 toward the rear side, the movable member 45 is forced to reverse clockwise to the initial position.

Figure 8:
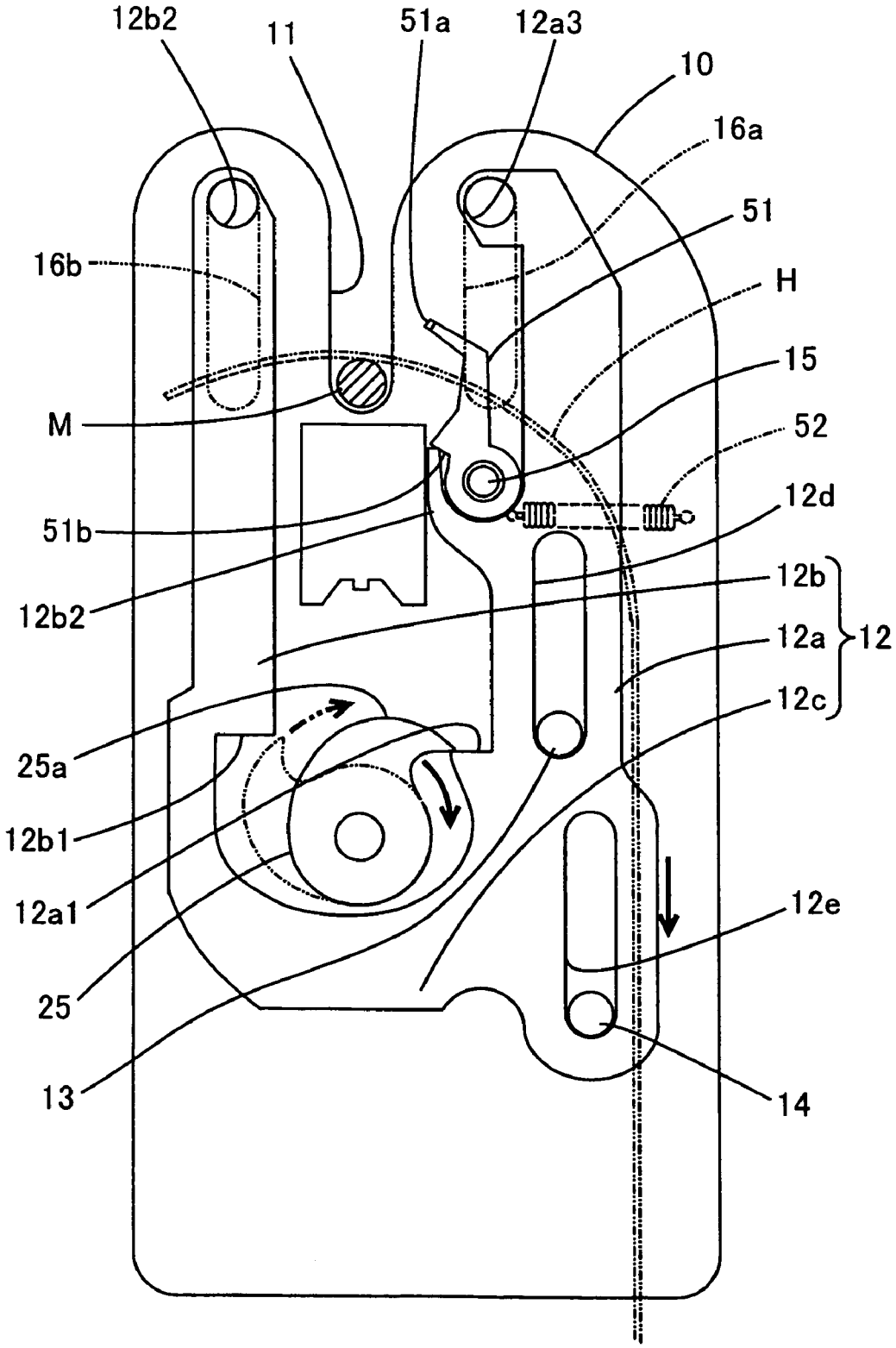
FIG. 8 is a plan view showing a positional relationship between a slide plate and a rotation arm when a tie-like member is fed up to a predetermined position by the tie feed mechanism.

(4) Tie Holding Mechanism:

As shown in FIG. 8, disposed inside the base member 10 is a slide plate 12 having a roughly U-like shape and wing sides 12*a* and 12*b* with free end thereof being oriented to the front side respectively. A base side 12*c* of the slide plate 12 is disposed in the rear area of the drive cam 25.

It is arranged so that the front edge of the base side 12*c* and the inside edges of the wing sides 12*a* and 12*b* come into contact with a convex portion 25*a* formed on the drive cam 25. The inner edge of the right wing side 12*a* is formed with a step 12*a*1, and when moving from the front-left, the convex portion 25*a* comes into contact with the pusher face of the step 12*a*1 to push the slide plate 12 toward the rear side. On the other hand, formed in the inner edge of the left wing side 12*b* is a step 12*b*1. When moving from the rear-right, the convex portion 25*a* comes into contact with the pusher face of the step 12*b*1 to push the slide plate 12 toward the front side.

Also, formed in the slide plate 12 in the front-rear direction are a pair of elongated holes 12*d* and 12*e*, and guide pins 13 and 14 are provided vertically from the base member 10 being inserted into the elongated holes so as to allow the slide plate 12 to move in the front-rear direction.

FIG. 8 shows a state at a point when the tie-like member H is fed up to a predetermined position by the tie feed mechanism 30. In this state, the convex portion 25*a* of the drive cam 25 comes into contact with the pusher face of the step 12*a*1. Here, when the drive cam 25 turns further clockwise, since the convex portion 25*a* pushes the pusher face toward the rear side, the slide plate 12 shifts toward the rear side. At this time, each of the elongated holes 12*d* and 12*e* allows the respective guide pins 13 and 14 to shift relatively toward the front side. Accordingly, the slide plate 12 shifts toward the rear side while being positioned in the right-left direction as shown in FIG. 9.

Figure 9:
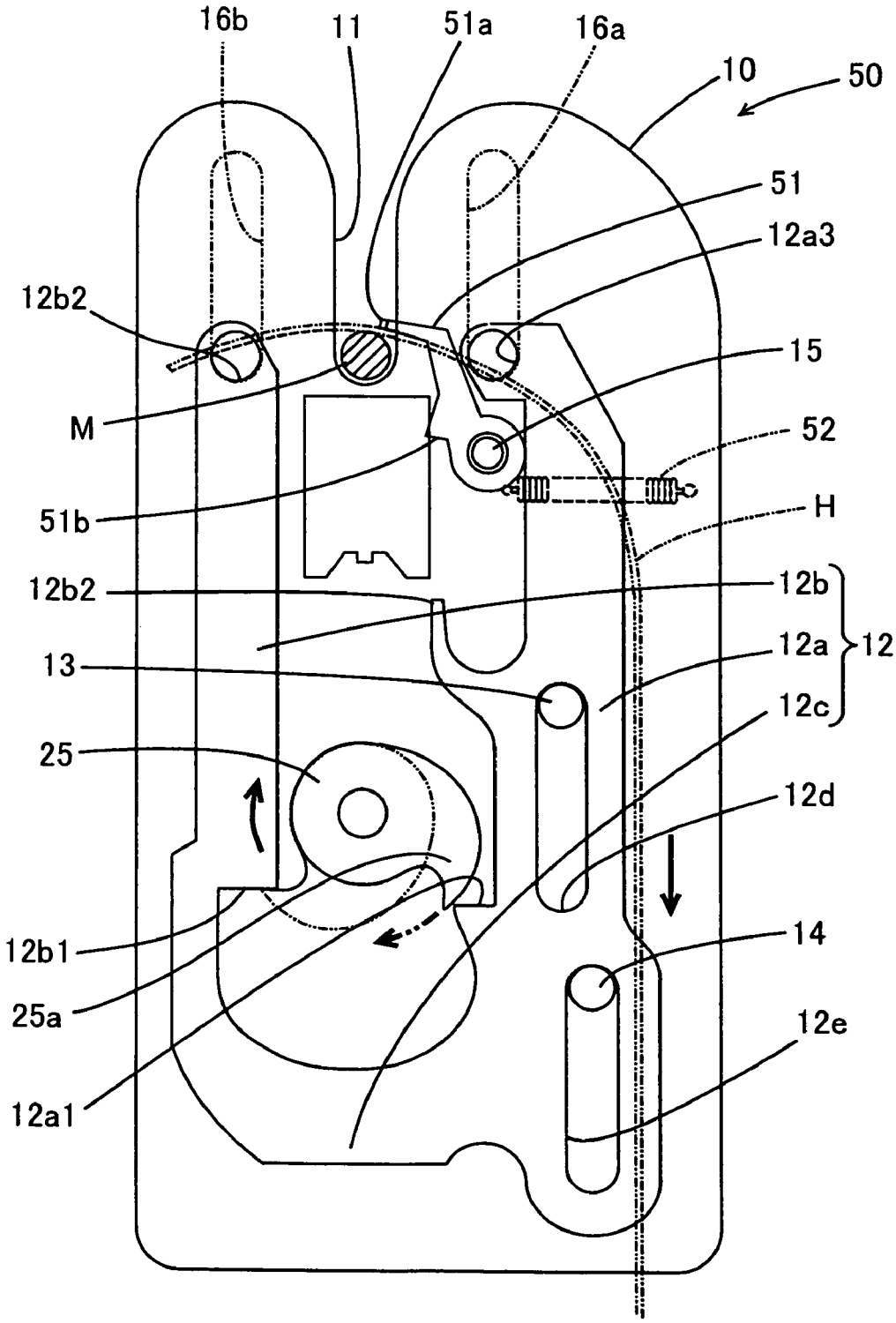
FIG. 9 is a plan view showing a positional relationship between the slide plate and the rotation arm when a tie holding portion holds the tie-like member.

Then, when the rotation of the drive cam 25 proceeds and the convex portion 25*a* comes into contact with the step 12*b*1 as shown with double-dashed line in FIG. 9, since the step 12*b*1 pushes the pusher face toward the front side this time, the slide plate 12 is made to shift toward the front side. At this time., since each of the elongated holes 12*d* and 12*e* allows the respective guide pins 13 and 14 to shift relatively toward the rear side, the slide plate 12 shifts toward the front side while being positioned in the right-left direction as shown with double-dashed line in FIG. 8.

Thus, when the slide plate 12 moves in the front-rear direction, the tie holding mechanism 50 shown in FIG. 8 is driven to press the tie-like member H, which has been fed up to a predetermined position, to the item M from the front side as shown in FIG. 9.

The tie holding mechanism 50 is provided with a rotation arm 51 formed with a tie holding portion 51*a* by bending the front end thereof upward as shown in FIG. 8. A pivot pin 15 provided vertically from the base member 10 rotatably supports the rear end of the rotation arm 51 disposed between the rear end of the rotation arm 51 and the right portion of the base member 10 is a pull spring 52.

Formed on the rear-left edge portion of the rotation arm 51 is a convex portion 51*b* which can come into contact with the front end of a hook-like projection 12*a*2 extended from the left end of the right wing side 12*a* of the slide plate 12. When the slide plate 12 is positioned at the front side, since the convex portion 51*b* is pushed toward the front side by the front end of the hook-like projection 12*a*2 against the biasing force of the pull spring 52 as shown in FIG. 8, the front end of the rotation arm 51 is turned clockwise and is received in an area at the right side of the opening 11.

On the other hand, when the slide plate 12 is positioned at the rear side, since the press to the convex portion 51*b* by the front end of the hook-like projection 12*a*2 is eliminated, the front end of the rotation arm 51 rotates counterclockwise by the restoring force of the pull spring 52 and extends over the opening 11 as shown in FIG. 9. At this time, as shown in FIG. 9, when the item M is being inserted up to the recess of the opening 11, the tie holding portion 51*a* presses the tie-like member H, which is fed in front of the item M, to the item M from the front side. Then, at the point when the tie holding mechanism 50 is driven, since the tie-like member H is in a state where the same has been fed up to a predetermined position, as described above, a central portion thereof from the front end to the blade receiving member 41 is pressed to the item M.

Figure 10:
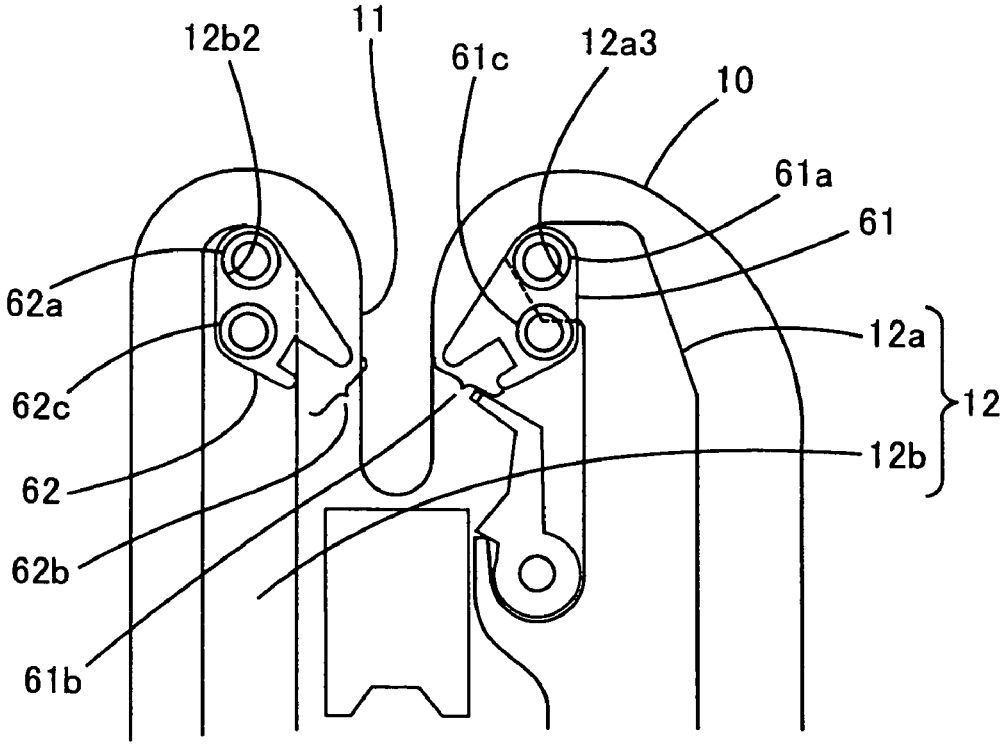
FIG. 10 is a plan view showing a state where a tie guide member is mounted to the slide plate.

(5) Tie Guide Mechanism:

Formed in the front end of the respective wing sides 12*a* and 12*b* of the slide plate 12 as shown in FIG. 8 and FIG. 9 are round holes 12*a*3 and 12*b*2 respectively. And inserted into the respective round holes 12*a*3 and 12*b*2, as shown in FIG. 10, are pivot pins 61*a* and 62*a* provided downward from each of the tie guide members 61 and 62. Also, when these pivot pins 61*a* and 62*a* are inserted into the respective round holes 12*a*3 and 12*b*2, the lower end portion thereof protrudes downward exceeding the slide plate, and is inserted into the guide grooves 16*a* and 16*b* respectively, which are formed in the base member 10 in the front/rear direction as shown in FIG. 8 and FIG. 9. Accordingly, when the slide plate 12 moves, the pivot pins 61*a* and 62*a* are guided in the front/rear direction by the guide grooves 16*a* and 16*b*.

Figure 11:
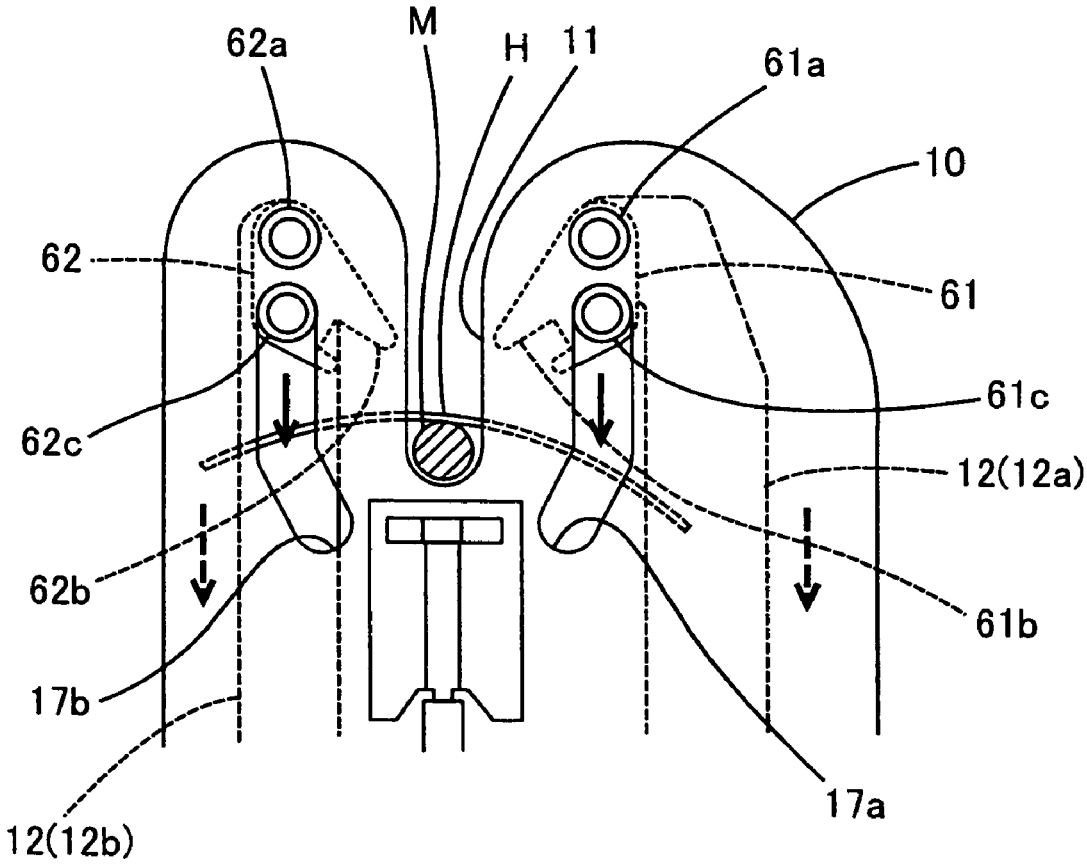
FIG. 11 is a plan view showing the operation of the tie guide member from the initial state.

Each tie guide member 61, 62 is provided with tie guide portion 61*b*, 62*b* respectively having a bifurcated shape oriented toward the opening 11, and in the front end thereof, the a pivot pin 61*a*, 62*a* is disposed being protruding respectively, and in the rear end thereof, a guide pin 61*c*, 62*c* is disposed being protruding upward respectively. Also, formed in the parts of the base member 10 above the tie guide members 61 and 62 are guide grooves 17*a* and 17*b* as shown in FIG. 11, and into these guide grooves 17*a* and 17*b*, guide pins 61*c*, 62*c* are inserted from the bottom. In this aspect, the guide grooves 17*a* and 17*b* constitute a guide mechanism according to the present invention. A ring-like member is mounted rotatably in the peripheral direction on the guide pins 61*c* and 62*c* respectively so as to allow smooth movement in the guide grooves 17*a* and 17*b*.

Figure 12:
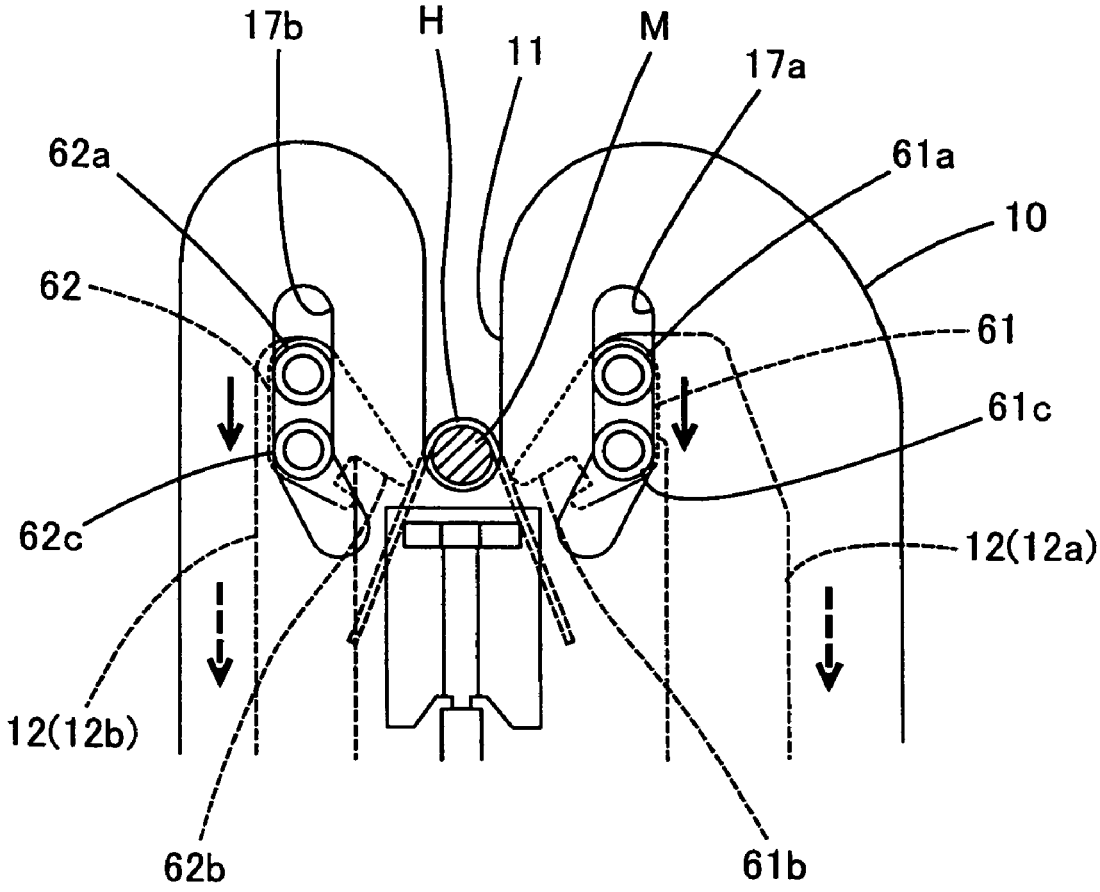
FIG. 12 is a plan view showing the operation of the tie guide member when both end sides of the tie-like member is guided backward.

Owing to the construction, as shown in FIG. 11, when the slide plate 12 moves toward the rear side, each tie guide member 61, 62 is guided toward the rear side along with the slide plate 12. At this time, since the guide pins 61*c* and 62*c* are guided along the guide grooves 17*a* and 17*b* formed in the front/rear direction, the tie guide members 61 and 62 move toward the rear side in parallel to each other without rotating while pressing the bifurcated portions formed on the tie guide portions 61*b* and 62*b* to the tie-like member H, and as shown in FIG. 12, the tie-like member H is turned around the periphery of the item M, and both ends of the tie-like member H are guided toward the rear side thereof.

The guide grooves 17*a* and 17*b* are formed so that the front sides thereof are parallel to each other in the front/rear direction, and the rear sides thereof are curved toward the opening 11 respectively. FIG. 12 shows a state at a point when the guide pins 61*c* and 62*c* are guided up to the vicinity of the curved points of the guide grooves 17*a* and 17*b*.

Figure 13:
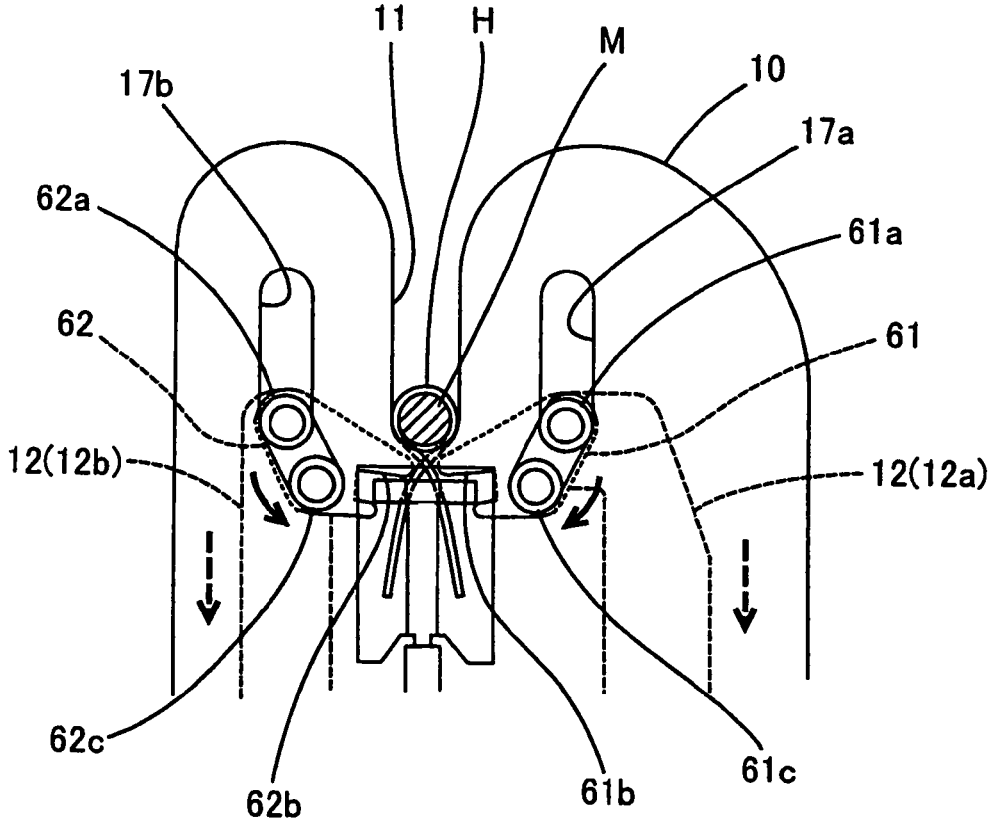
FIG. 13 is a plan view showing the operation of the tie guide member when both end sides of the tie-like member are turned toward the back of an item.

From this point, when the slide plate 12 further moves toward the rear side, since the guide pins 61*c* and 62*c* moves toward the opening 11 along the guide grooves 17*a* and 17*b*, the tie guide members 61 and 62 begin to rotate around the pivot pin 61*a*, 62*a* as the fulcrum respectively as shown in FIG. 13. That is, as shown in FIG. 13, the tie guide member 61 turns clockwise so that the tie-like member H is turned around the item M from the right side toward the rear side thereof; and the tie guide member 62 turns counterclockwise so that the tie-like member H is turned around the item M from the left side toward the rear side thereof. Then, tie guide portions 61*b* and 62*b* of the tie guide members 61 and 62 are made closer to each other at the rear side of the item M, thereby both end sides of the tie-like member H are made closer to each other.

When the slide plate 12 move toward the front side, after being guided up to the vicinity of the curve of the guide grooves 17*a* and 17*b* while turning in the opposite direction respectively around the pivot pins 61*a* and 62*a* as the fulcrum, the tie guide members 61 and 62 are guided in parallel to each other toward the front side up to the initial position.

(6) Tying Mechanism

Figure 14:
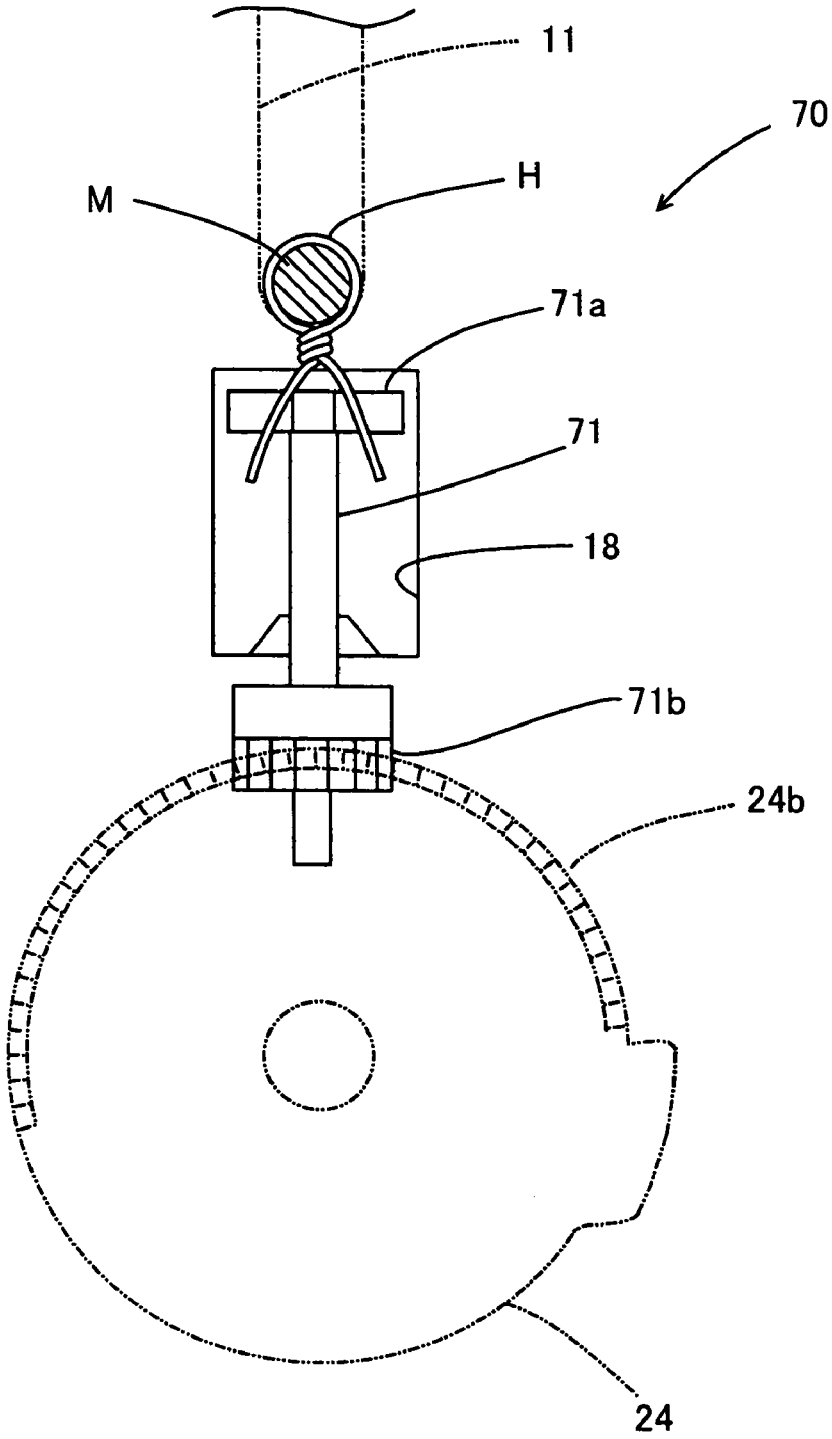
FIG. 14 is a plan view showing a primary construction of a tying mechanism.

In the base member 10, as shown in FIG. 14, a rectangular hole 18 is formed in the rear side of the opening 11, and in the area from the rectangular hole 18 to the rotating member 20, the tying mechanism 70 is constituted.

Figure 15:
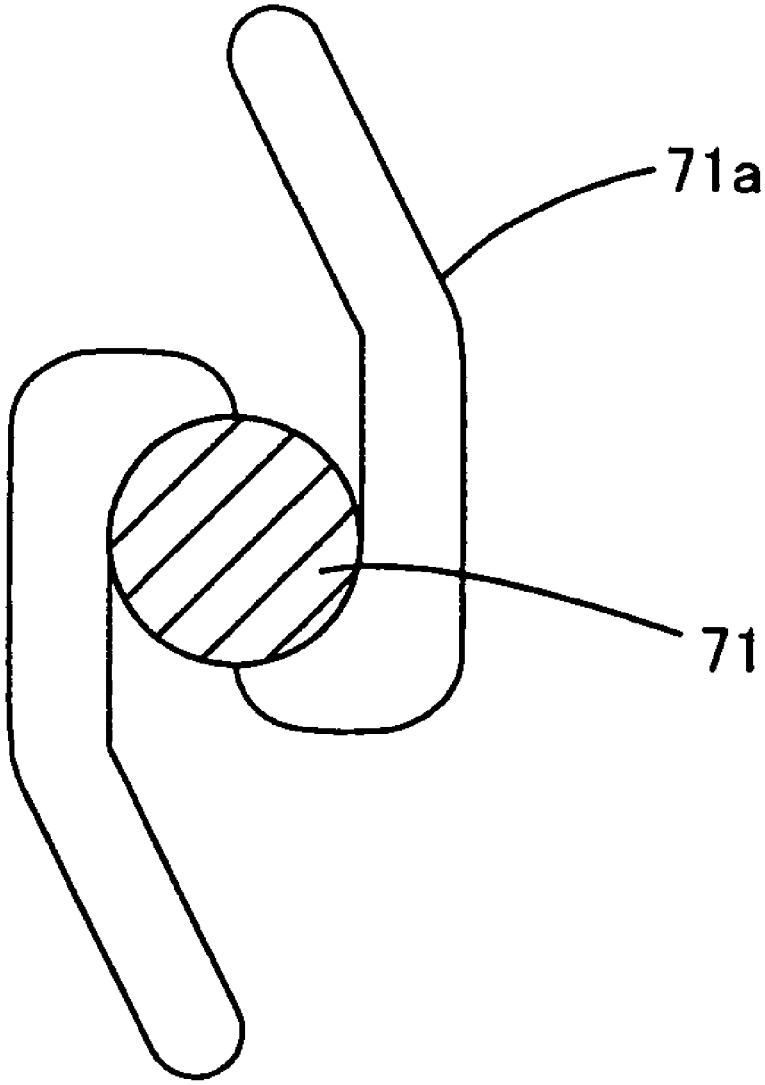
FIG. 15 is a sectional view showing a construction of a twist head.

Disposed between the rectangular hole 18 and the rotating member 20 is a shaft 71 of which axis is oriented in the front/rear direction. Integrally formed on the front end of the shaft 71 is a twist head 71*a* having a roughly S-like shape as shown in FIG. 15. Also, integrally formed on the rear end of the shaft 71 as shown in FIG. 14 is a gear unit in which a gear 71*b* is provided in the peripheral direction of the shaft 71.

Figure 16:
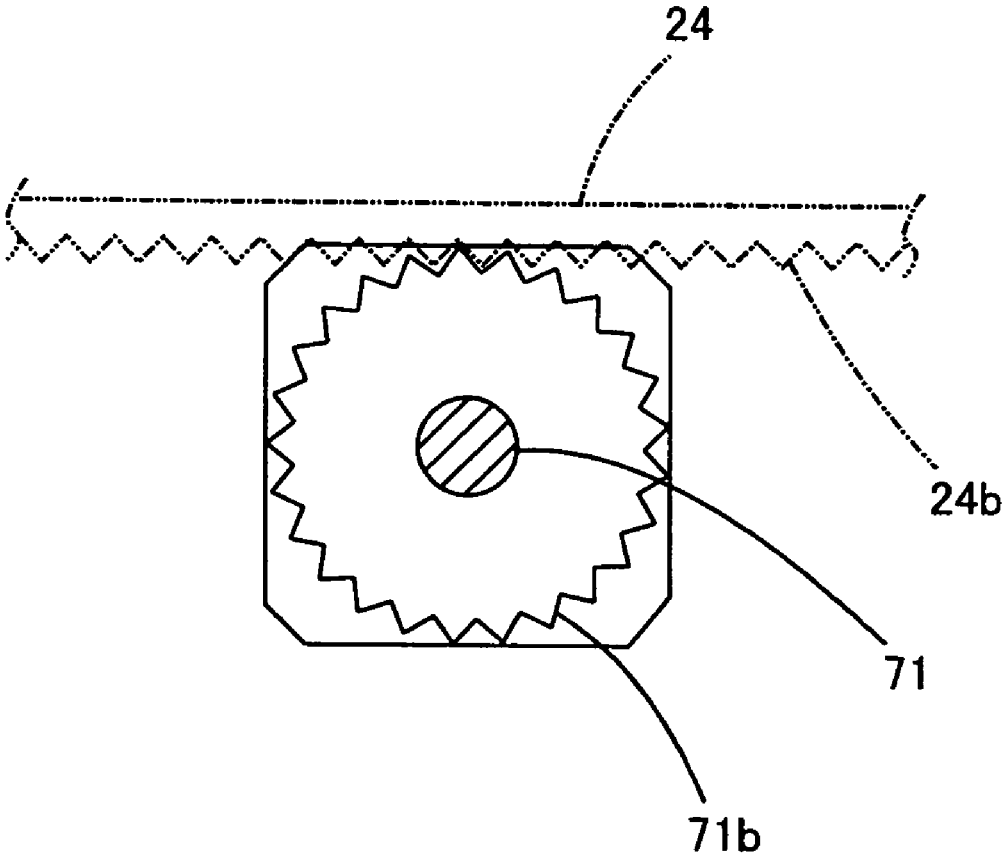
FIG. 16 is a sectional view showing a gearing state between a drive gear and a gearbox.

Since it is arranged so that a gear 24*b* formed in a part of the peripheral lower face of the drive gear 24 can be meshed with the gear 71*b* as shown in FIG. 16, the shaft 71 rotates in the predetermined directions when the gear 24*b* is turned in the right/left direction accompanying the rotation of the drive gear 24.

Then, since also the twist head 71*a* formed on the front end of the shaft 71 turns, the twist head 71*a* catches both end sides of the tie-like member H which have been turned around the item M by the tie guide mechanism 60, and twist them to tie the item M as shown in FIG. 14.

Figure 17:
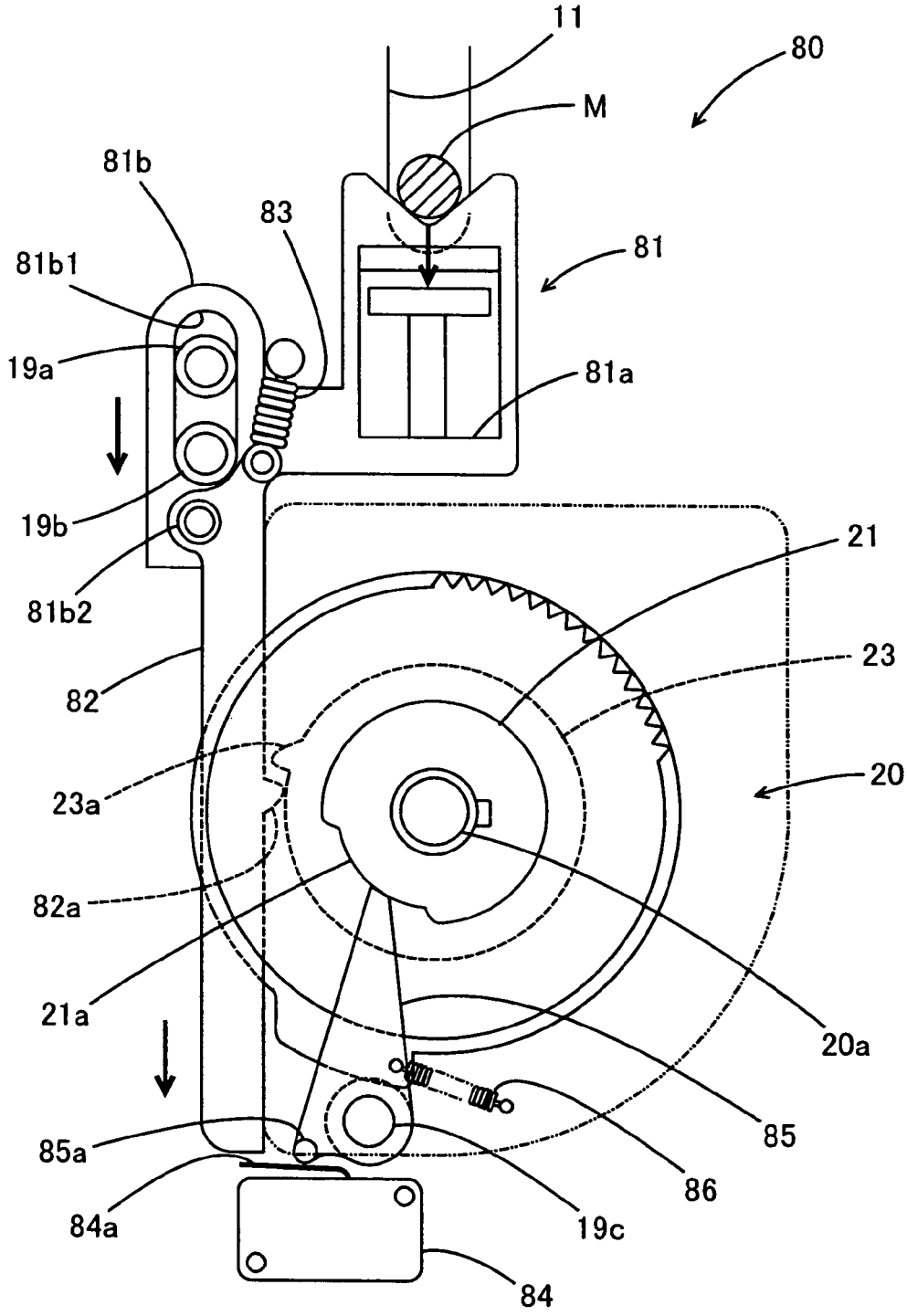
FIG. 17 is a plan view showing the operation of a switch mechanism from the initial state.

(7) Switch Mechanism:

In the base member 10, as shown in FIG. 17, from the recess of the opening 11 to the left rear end, the switch mechanism 80 for turning on the power supply to the motor to drive and rotate the shaft 20*a* of the rotating member 20 is provided.

Disposed in an area behind the recess of the opening 11 is a movable member 81, which has a rectangular opening 81*a* and is provided with an arm portion 81*b* extending toward the left side from the left side edge thereof. Formed in the front/rear direction in the arm portion 81*b* is an elongated hole 81*b*1. Into the elongated hole 81*b*1, guide pins 19*a* and 19*b* extending vertically from the base member 10 are inserted movably in the front/rear direction. Owing to this, when the item M is pressed to the recess of the opening 11, the movable member 81 becomes movable toward the rear side while being guided along the elongated hole 81*b*1 toward the rear side by the guide pins 19*a* and 19*b*.

Provide at the left-rear end of the arm portion 81*b* is a pivot pin 81*b*2 protruding upward. The pivot pin 81*b*2 rotatably supports the front end of the oscillating arm 82. Also, formed on the right side face of the oscillating arm 82 is a convex portion 82*a* protruding rightward. It is arranged so that the convex portion 82*a* can come into contact with the drive cam 23. Further, disposed between the right side of the front end of the oscillating arm 82 and the front side of the base member 10 is a pull spring 83. The pull spring 83 biases the oscillating arm 82 counterclockwise; thereby the convex portion 82*a* is pressed to a peripheral portion of the drive cam 23.

Disposed on the base member 10 at the rear side of the oscillating arm 82 is a tact switch 84. A switch piece 84*a* of the tact switch 84 is disposed movably forward/backward at the rear side of the oscillating arm 82.

Disposed in front of the tact switch 84 is a rotation member 85 having a roughly triangle shape, and the rotation member 85 is rotatably supported by a pivot pin 19*c* protruding upward from the base member 10. Also, it is arranged so that the apex at the front side of the rotation member 85 can come into contact with the drive cam 21, and provided to the apex at the left side of the rotation member 85 protruding upward is a press pin 85*a* which can come in contact with the switch piece 84*a*. Further, disposed in front of the pivot pin 19*c* and between the right side of the base member 10 and the same is a pull spring 86, and the rotation member 85 is always biased clockwise around the pivot pin 19*c* as the fulcrum.

Figure 18:
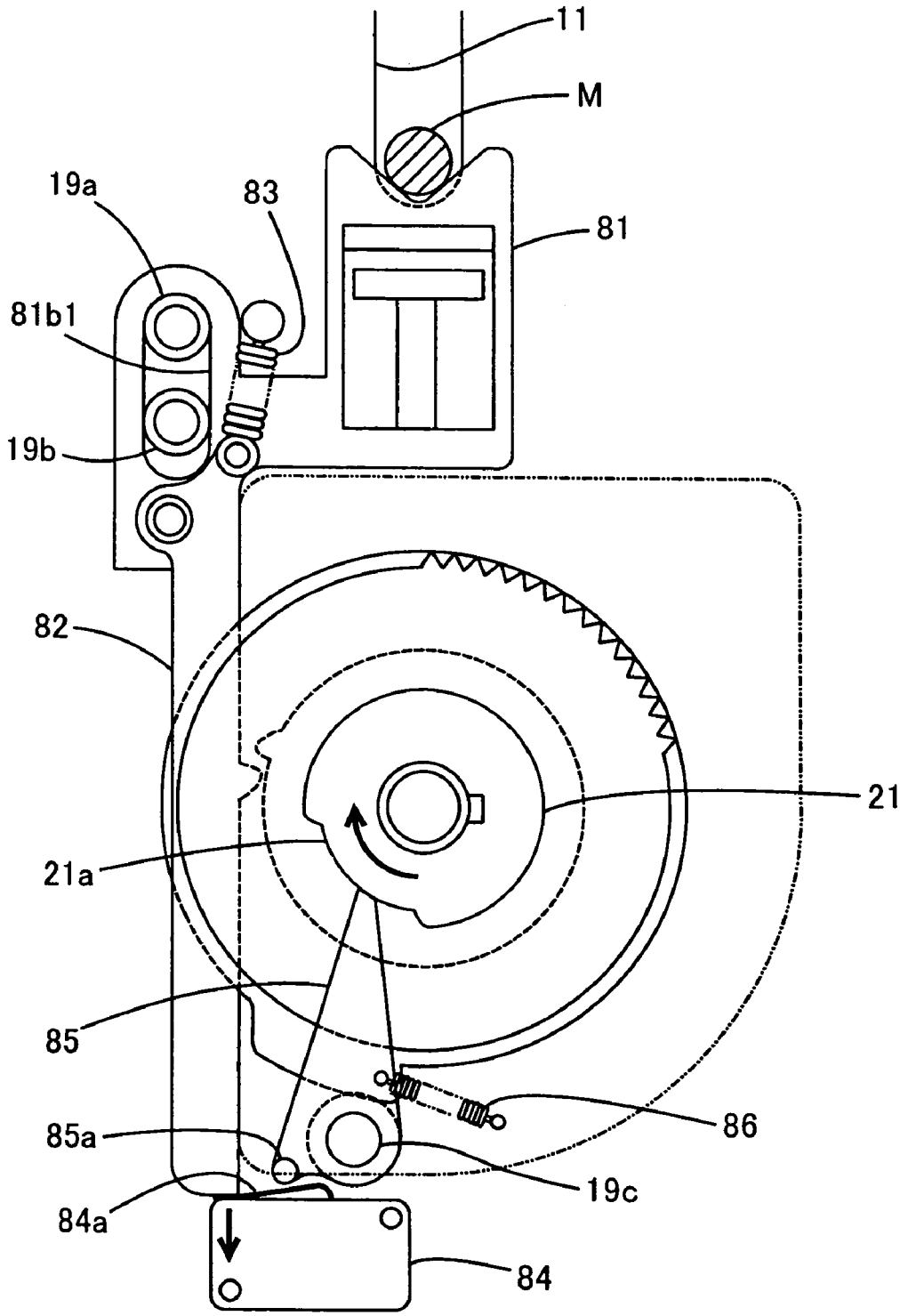
FIG. 18 is a plan view showing a state when an oscillating arm has pressed a switch piece.

Owing to the construction, as shown in FIG. 17, when the item M is pressed to the recess of the opening 11, since the front end portion of the movable member 81 is pressed toward the rear side by the item M, the movable member 81 moves the elongated hole 81*b*1 toward the rear side along the guide pins 19*a* and 19*b* and performs a parallel movement toward the rear side against the biasing force of the pull spring 83. Owing to this arrangement, the oscillating arm 82 also performs a parallel movement toward the rear side along with a movable member 81, and as shown in FIG. 18, the switch piece 84*a* is pressed toward the rear side by the rear end of the oscillating arm 82 causing the tact switch 84 to turn on.

In a part of the periphery edge of the drive cam 21, a concave portion 21*a* is formed. When the apex at the front side of the rotation member 85 faces the concave portion 21*a* as shown in FIG. 17, the rotation member 85 is biased clockwise around the pivot pin 19*c* as the fulcrum by the pull spring 86, thus the press pin 85*a* is separated away from the switch piece 84*a*.

Figure 19:
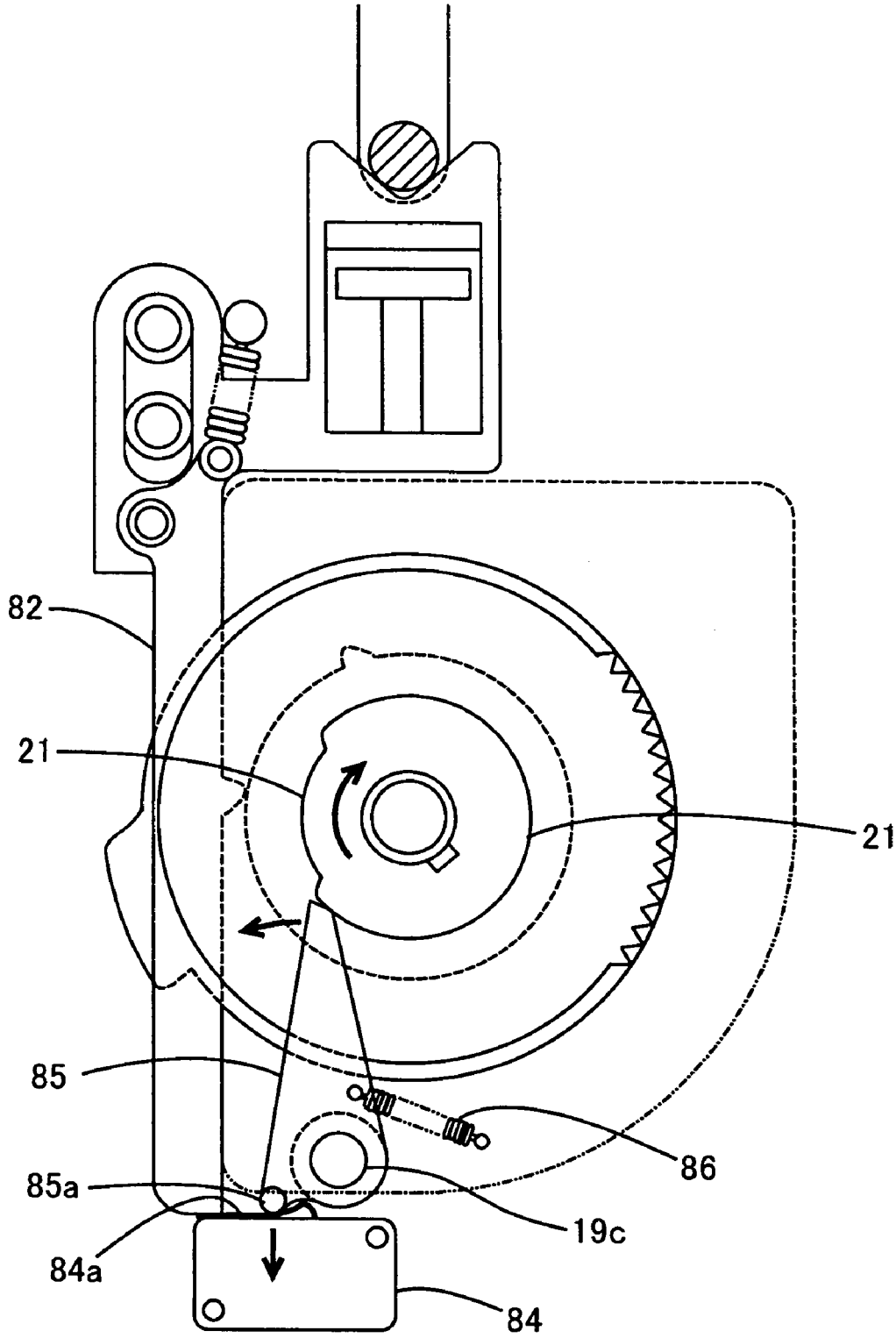
FIG. 19 is a plan view showing a state when a press pin has pressed the switch piece.

However, when the tact switch 84 is turned on and the drive cam 21 turns clockwise, as shown in FIG. 19, the apex at the front side of the rotation member 85 faces a portion where is higher by one step being interposed by a step formed at an end of the concave portion 21*a* of the drive cam 21. Then, the apex at the front side of the rotation member 85 is pressed leftward by the periphery edge portion of the drive cam 21, the rotation member 85 rotates counterclockwise around the pivot pin 19*c* as the fulcrum, and the press pin 85*a* presses the switch piece 84*a* toward the rear side along with the oscillating arm 82.

Accordingly, at this point, even when the press of the movable member 81 by the item M is released and the oscillating arm 82 is returned toward the front side by the restoring force of the pull spring 83 and thus the press of the switch piece 84*a* is released, since the press of the switch piece 84*a* by the press pin 85*a* is continued, the tact switch 84 is not turned off until the sequential tying operation by the tie feed mechanism 30, the cutter mechanism 40, the tie holding mechanism 50, the tie guide mechanism 60 and the tying mechanism 70 is completed.

Figure 20:
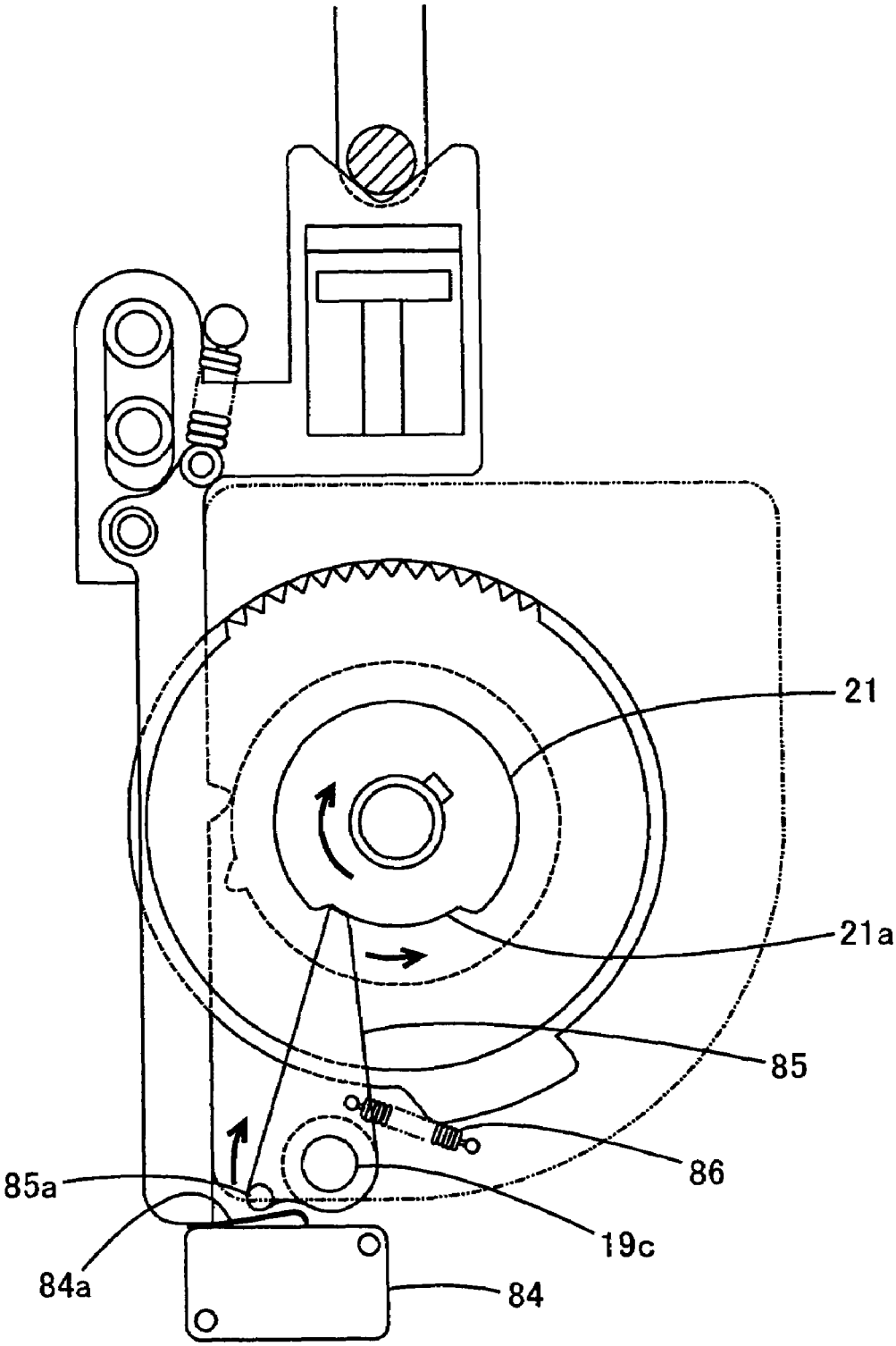
FIG. 20 is a plan view showing a state when the pressure of the switch piece by the press pin has been released.

When the rotation of the drive cam 21 further proceeds and the sequential tying operation has been completed, since the apex at the front side of the rotation member 85 falls into the concave portion 21*a* as shown in FIG. 20, the leftward press to the apex at the front side of the rotation member 85 is released. Then, due to the restoring force by the pull spring 86, the rotation member 85 rotates clockwise around the pivot pin 19*c* as the fulcrum, and thus the press to the switch piece 84*a* by the press pin 85*a* is eliminated.

Figure 21:
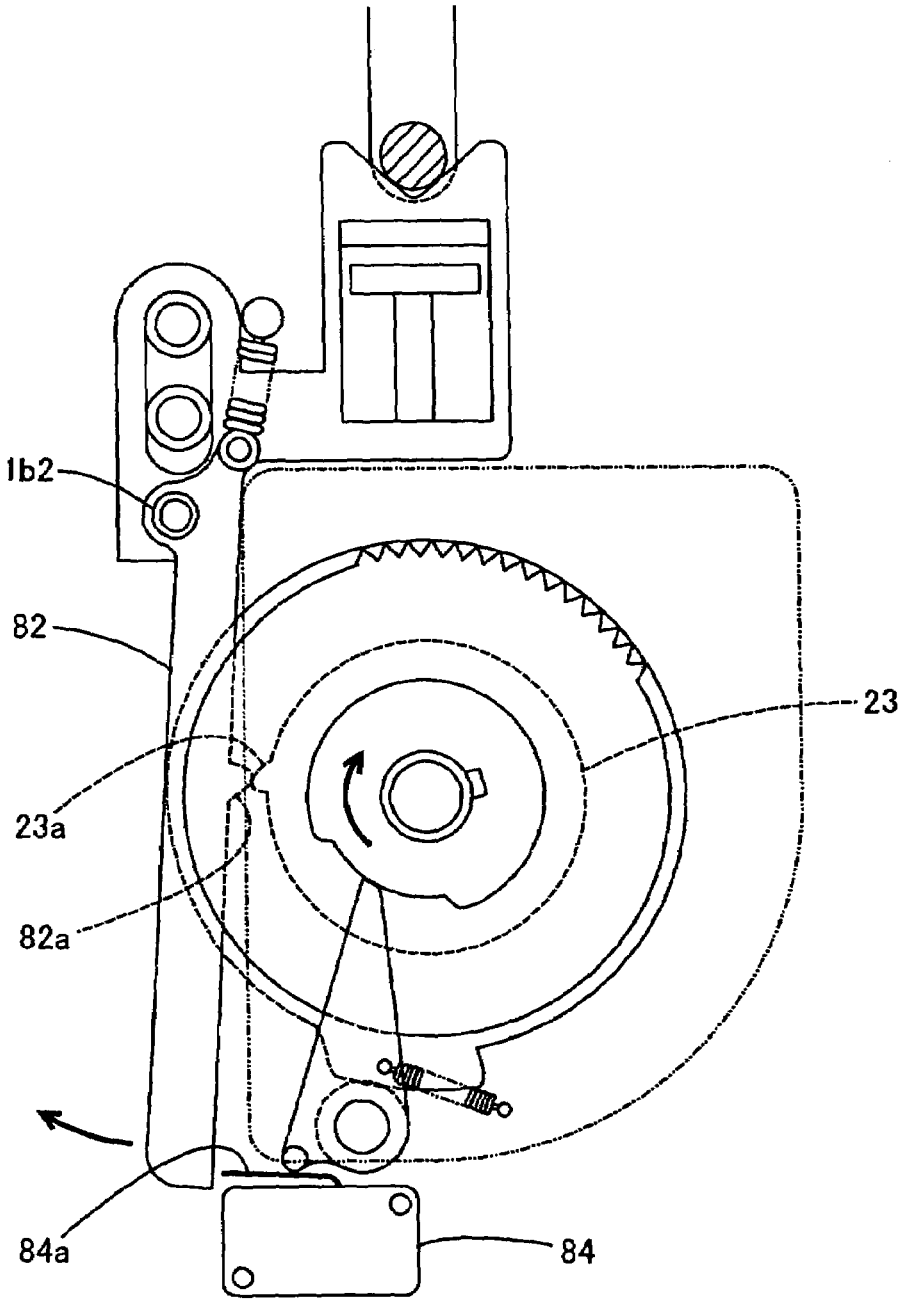
FIG. 21 is a plan view showing a state when the oscillating arm has been pressed leftward by a drive cam.

Also, when a convex portion 23*a* formed on the drive cam 23 faces the convex portion 82*a* as shown in FIG. 21, since convex portion 23*a* pushes the convex portion 82*a* leftward, the oscillating arm 82 rotates clockwise around the pivot pin 82*b*2 as the fulcrum and moves toward the left side of the switch piece 84*a*, thus the tact switch 84 is turned off.

Figure 22:
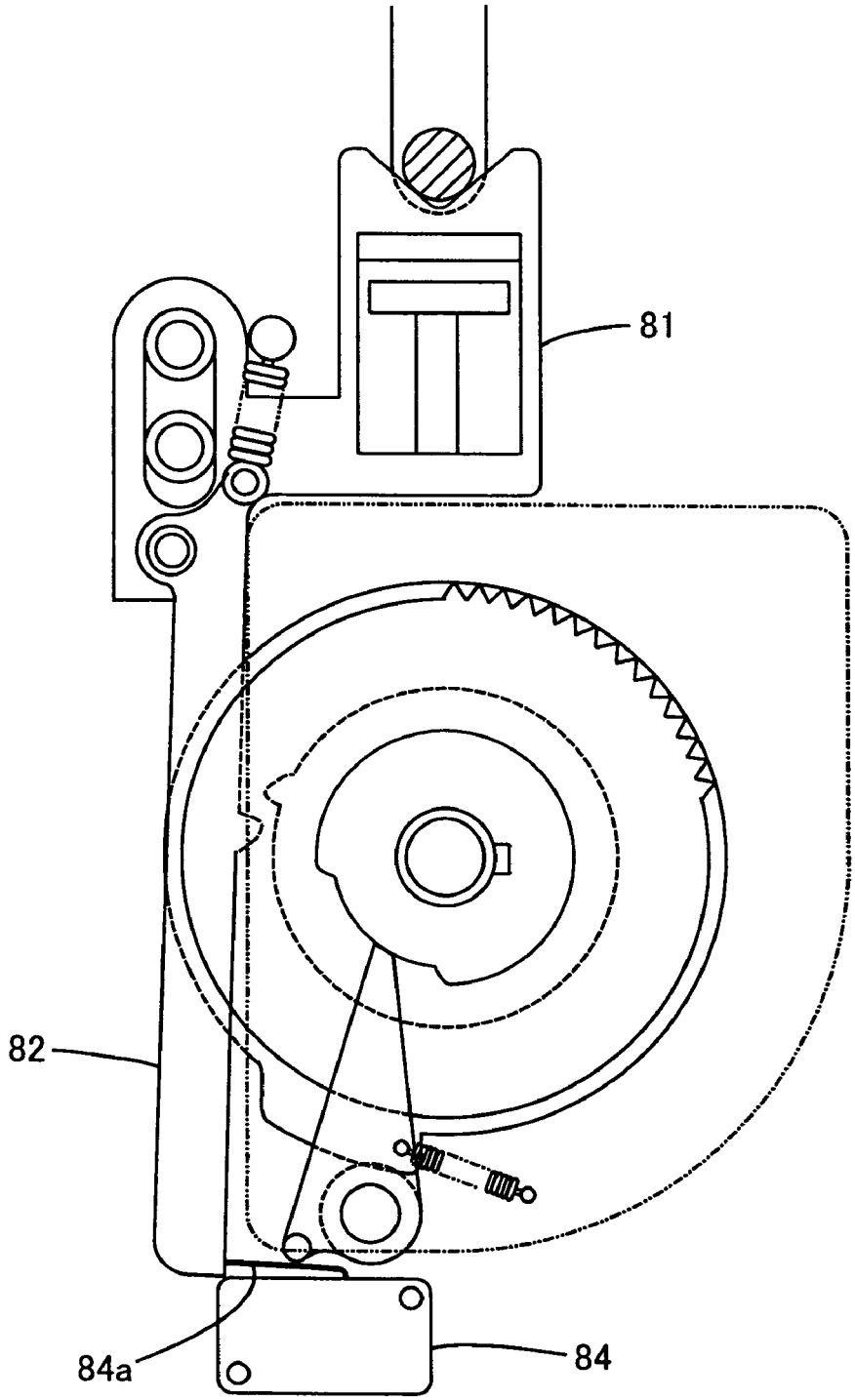
FIG. 22 is a plan view showing a switch mechanism when a sequence of tying operation has completed.

Then, when the convex portion 23*a* move away from the point where the same faces the convex portion 82*a*, due to elimination of leftward press by the convex portion 23*a*, the oscillating arm 82 rotates counterclockwise. However, since the rear end of the oscillating arm 82 comes into contact with the front end of the switch piece 84*a*, even in a state where the movable member 81 is pressed toward the rear side as shown in FIG. 22, the rear end of the oscillating arm 82 does not press the switch piece 84*a* toward the rear side. Accordingly, the tact switch 84 is remained being off.

(8) Chattering Preventive Structure:

In the binding machine main body 100 according to the embodiment of the present invention, in addition to the construction relevant to the tying operation, various arrangements are made.

Figure 23:
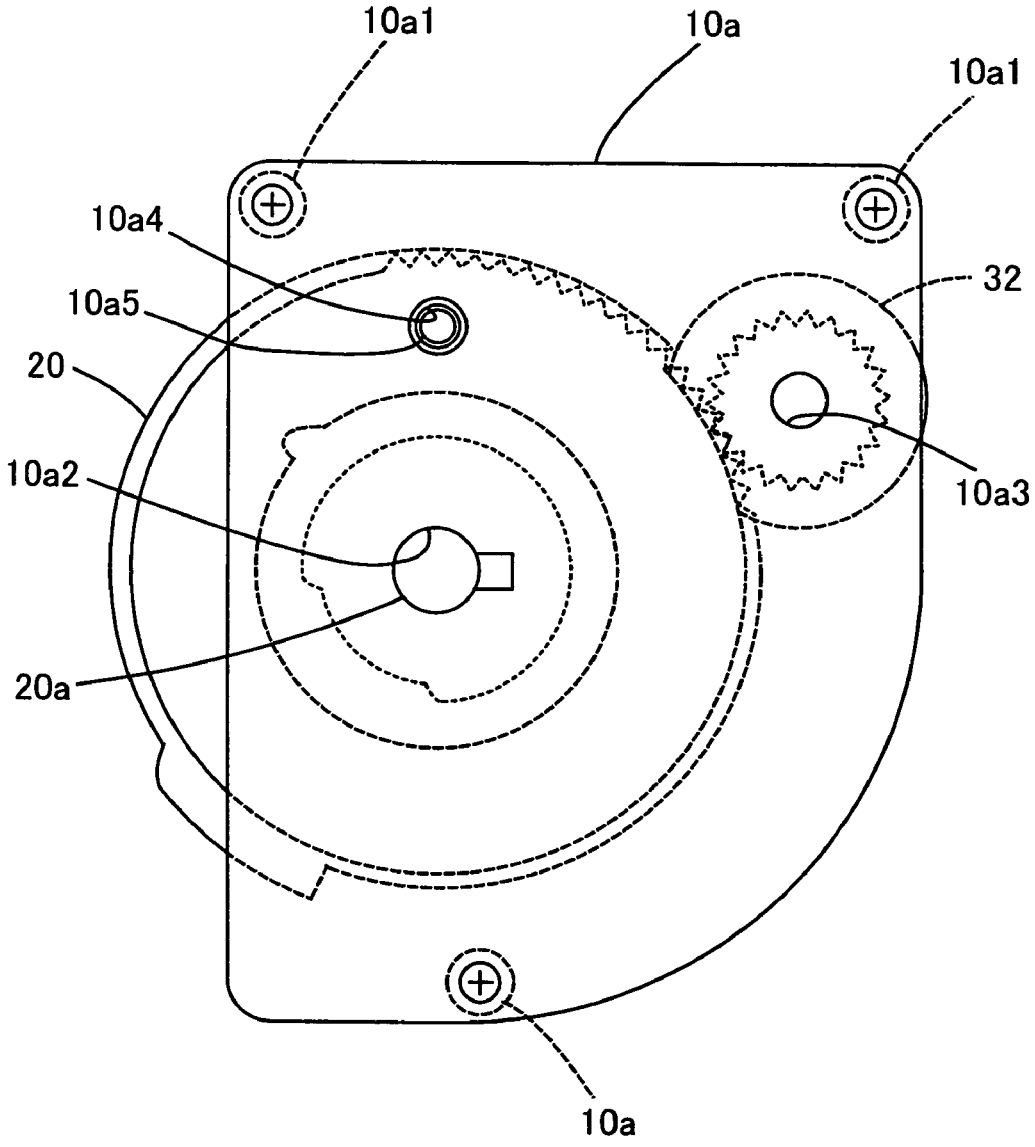
FIG. 23 is a plan view illustrating an additional construction in a protection cover.

For example, as shown in FIG. 23, in order to protect the rotating member 20 from the top, a protection cover 10*a* is provided to the upper face of the base member 10. The protection cover 10*a* is fixed by screws on the upper face of the base member 10 being interposed by spacers 10*a*1, which are longer in the axial direction than the height of the rotating member 20.

Here, formed at the center and the right end side of the protection cover 10*a* are through holes 10*a*2 and 10*a*3 for allowing the top ends of the shaft 20*a* and a shaft of the first tie feed roller 32. By allowing the top ends of the respective shafts to go through these through holes 10*a*2 and 10*a*3, the shafts are maintained in the substantially vertical direction, and prevented from axial displacement.

Figure 24:
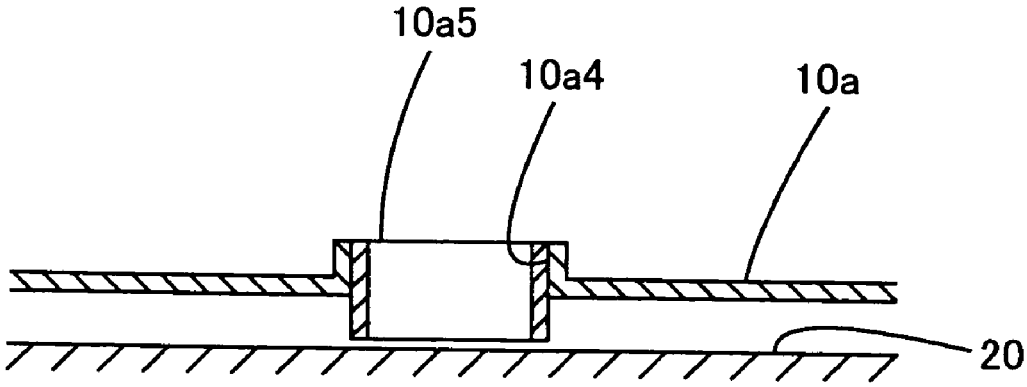
FIG. 24 is a sectional view showing a positional relationship between a cylindrical member attached to the protection cover and the rotating member.

In the protection cover 10*a*, a through hole 10*a*4 is also formed in front of the through hole 10*a*2. A cylindrical member 10*a*5 is inserted into the through hole 10*a*4 by force. As shown in FIG. 24, it is arranged so that, while forming a slight space, the lower end of the cylindrical member 10*a*5 faces the upper face of the rotating member 20. In order to prevent the rotating member 20 from running out of the horizontal plane, the cylindrical member 10*a*5 restricts the position of the upper face of the rotating member 20 by the lower end of the cylindrical member 10*a*5 to ensure the mesh between the gears 22*a* and 24*b*.

Figure 25:
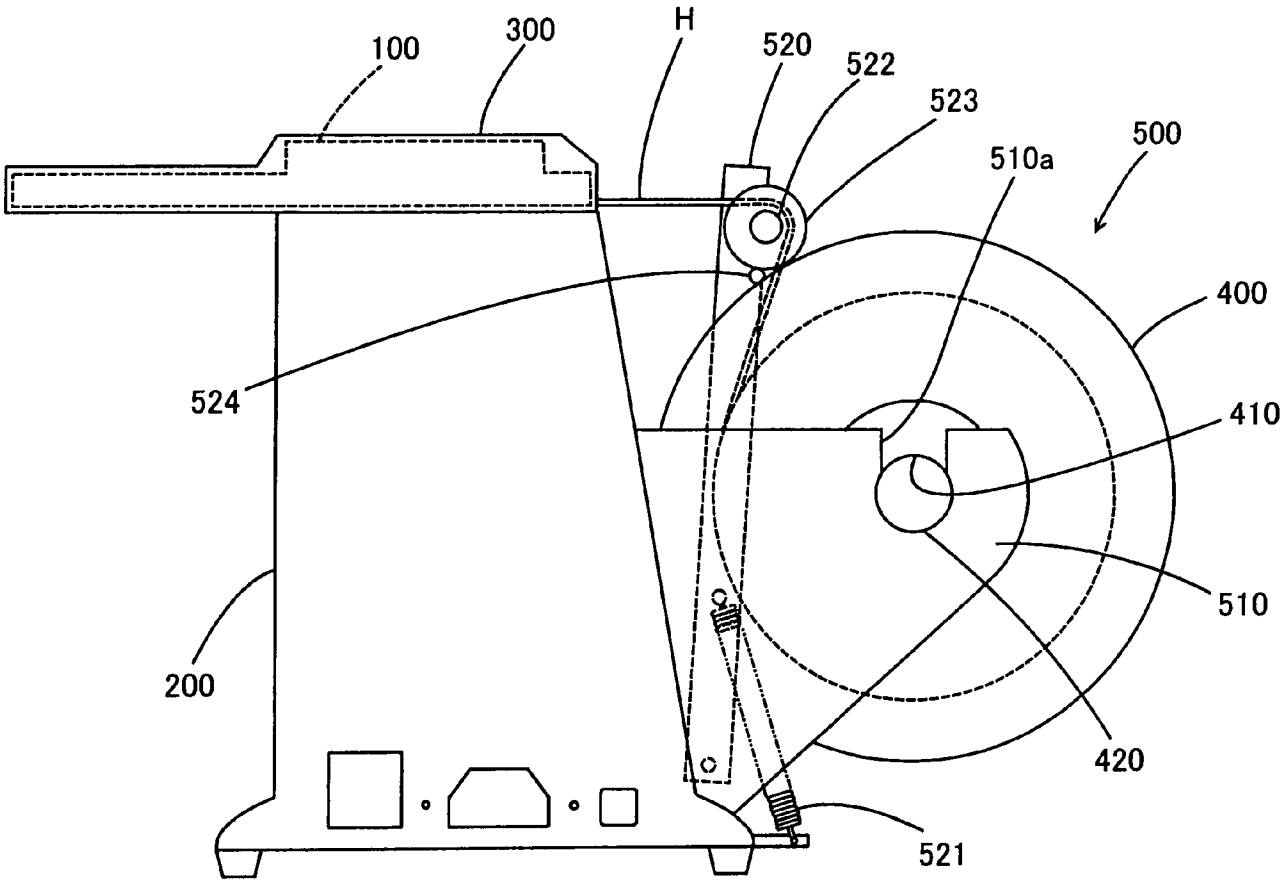
FIG. 25 is a side view showing the entire construction of the binding machine.

(9) Outline of Entire Binding Machine:

The binding machine main body 100 having the construction is, as shown in FIG. 25, mounted on the upper part of a motor box 200 with the base member oriented in the roughly horizontal direction. In the motor box 200, in addition to a drive motor, a power supply switch, a power supply circuit and the like are contained.

Here, since the binding machine main body 100 is provided with a protection cover 300 so as to cover the entire from the top thereof, each member disposed on the base member 10 is protected from the outside.

Attached to the rear part of the motor box 200 is a tie-like member supply unit 500 for supplying a tie-like member H wound on a drum 400 to the binding machine main body.

Provided on the back side face of the motor box 200 protruding therefrom at a distance slightly wider than the thickness of the drum 400 is a pair of drum support arms 510 and 510. In the upper sides in the front end side of the drum support arms 510 and 510, openings 510*a* and 510*a* are formed.

In the drum 400, a through hole 410 is formed in the axial direction, and into the through hole 410, an axel support member 420 is inserted therethrough. Since both ends of the axel support member 420 are inserted respectively into the openings 510*a*, 510*a*, the drum support arms 510, 510 support the drum 400 rotatably.

Interposed between the feed out position of the tie-like member H in the drum 400 and the rear end of the binding machine is a tension arm 520. The lower end of the tension arm 520 is supported rotatably at a lower portion of the rear end of the motor box 200 so that the upper portion is biased in the rear-lower direction by the spring 521.

Also, integrally provided at the upper end side of the tension arm 520 is a shaft 522 with the axis thereof oriented vertically with respect to the drawing. Into the shaft 522, a rotating member 523, which has a roughly cylinder-like shape and a through hole in the axial direction, is inserted.

Owing to the construction, the front end of the tie-like member H is fed out from a lower portion of the drum 400 to the binding machine main body 100 via the rotating member 523. Accordingly, when the tie feed mechanism 30 in the binding machine main body 100 feeds out the tie-like member H, the upper part of the tension arm 520 inclines forward against the biasing force of the spring 521. When the tie feed mechanism 30 does not feed out the tie-like member H, the upper part of the tension arm 520 is inclined toward the rear side by the biasing force of the spring 521 to remove a slack of the tie-like member H.

Disposed in a lower part of the rotating member 523 in the tension arm 520 is a shaft 524 of which axis is oriented vertically with respect to the drawing. The purpose of this is, when the upper part of the tension arm 520 is inclined toward the rear side by the biasing force of the spring 521, to restrict the inclination angle of the tension arm 520 by allowing the shaft 524 to come into contact with the drum 400.

Further, in order to avoid giving shock to the drum 400 when the shaft 524 comes into contact with the drum 400, an elastic member is provided to the shaft 524 so as to cover the peripheral surface thereof.

As described above, in the tie guide mechanism according to the embodiment of the present invention, the tie guide members 61 and 62 move toward the rear side parallel to each other at the sides of the opening 11, turn the tie-like member H around the periphery of the item M, and guide both end sides of the tie-like member H to the rear side thereof. Then, the tie guide members 61 and 62 turn respectively around the pivot pins 61*a* and 62*a* as the fulcrum and move to the rear side, and by making the tie guide portions 61*b* and 62*b* closer to each other at the rear part of the item M, the both end sides of the tie-like member H are made closer to each other. Thus, it is made possible to provide a binding machine with which an operator can carry out tying operation without sensation of fear.

INDUSTRIAL APPLICABILITY

As described above the present invention can provide a binding machine with which an operator can carry out tying operation without sensation of fear.

Also, according to the second and third embodiments of the present invention, the construction of the tie guide mechanism can be simplified.

What is claimed is:

1. A binding machine comprising:

a base member having a covered area and defining a bifurcated opening into which an item to be bound can be inserted;

a tie feed mechanism that feeds out a tie-like member of a predetermined length, the tie-like member having a first part and a second parts and traversing the opening of said base member;

a tie guide mechanism for guiding the tie-like member and having a pair of tie guide members and a guide mechanism for the pair of tie guide members, the tie guide members capable of moving substantially parallel to the opening of said base member and moving only within the covered area of said base member, and wherein the guide mechanism guides the tie guide members for pressing the first and second parts of the tie-like member closer to each other; and a tying mechanism for tying by twisting the first and second parts of said tie-like member.

2. The binding machine according to claim 1, wherein each of the tie guide members is supported by a movable member which is driven together in the direction parallel to the opening of said base member.

3. The binding machine according to claim 1 or 2, wherein said guide mechanism is provided with a concave-convex structure, which is formed between said base member and the respective tie guide members, and moves the tie guide members roughly parallel to said opening portion, and wherein the tie guide members come closer so as to bring the first and the second parts of the tie member closer.

* * * * *